US007694750B2

(12) United States Patent
Tsubakimoto et al.

(10) Patent No.: US 7,694,750 B2
(45) Date of Patent: Apr. 13, 2010

(54) HAMMER DRILL

(75) Inventors: Hiroyuki Tsubakimoto, Osaka (JP); Koichi Hashimoto, Osaka (JP); Hisashi Oda, Osaka (JP); Hidekazu Yuasa, Osaka (JP); Kunihiko Tatsu, Osaka (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 15 days.

(21) Appl. No.: 11/441,141

(22) Filed: May 26, 2006

(65) Prior Publication Data

US 2006/0266536 A1 Nov. 30, 2006

(30) Foreign Application Priority Data

May 26, 2005 (JP) ..... 2005-154701
Dec. 9, 2005 (JP) ..... 2005-357011

(51) Int. Cl.
*B25D 11/10* (2006.01)

(52) U.S. Cl. ..... 173/178; 173/47; 173/48; 173/13; 173/104; 173/176; 192/56.1; 192/54.1; 192/54.52

(58) Field of Classification Search ..... 173/176, 173/178, 48, 47, 13, 104; 192/56.1, 54.1, 192/54.52
See application file for complete search history.

(56) References Cited

U.S. PATENT DOCUMENTS

| | | | | |
|---|---|---|---|---|
| 3,828,863 A | 8/1974 | Bleicher et al. | | |
| 3,931,744 A * | 1/1976 | Wunsch | ..... | 173/48 |
| 5,201,373 A * | 4/1993 | Bloechle | ..... | 173/109 |
| 5,588,496 A * | 12/1996 | Elger | ..... | 173/178 |
| 6,142,242 A * | 11/2000 | Okumura et al. | ..... | 173/48 |
| 6,688,406 B1 * | 2/2004 | Wu et al. | ..... | 173/48 |
| 6,810,969 B2 * | 11/2004 | Meixner | ..... | 173/201 |
| 6,892,827 B2 * | 5/2005 | Toyama et al. | ..... | 173/48 |
| 7,168,503 B1 * | 1/2007 | Teng | ..... | 173/48 |
| 2007/0131439 A1 * | 6/2007 | Hashimoto et al. | ..... | 173/48 |

FOREIGN PATENT DOCUMENTS

| | | | | |
|---|---|---|---|---|
| CN | 1457286 | 11/2003 | | |
| DE | 10006641 | * 9/2000 | ..... | 173/48 |
| EP | 0 318 480 | 3/1991 | | |
| EP | 1726407 A2 | * 11/2006 | | |
| EP | 1795307 A2 | * 6/2007 | | |
| EP | 1795311 A2 | * 6/2007 | | |
| GB | 2 404 891 | 2/2005 | | |

* cited by examiner

*Primary Examiner*—Rinaldi I. Rada
*Assistant Examiner*—Michelle Lopez
(74) *Attorney, Agent, or Firm*—Bacon & Thomas, PLLC

(57) ABSTRACT

A hammer drill includes a motor; a spindle rotatingly driven by the motor and holding an output bit; a motion conversion member for converting rotational movement of the motor to reciprocating movement; a striker reciprocatingly driven by the motion conversion member for applying an axial striking force to the output bit; a striking-motion-releasing mechanism for releasing the striking force applying action exercised by the striker; and a tightening-torque adjusting clutch for interrupting the transfer of the rotational force to the output bit by increasing a load torque.

8 Claims, 28 Drawing Sheets

HAMMER DRILL

FIELD OF THE INVENTION

The present invention relates to a hammer drill adapted to apply an axial striking force against a rotatingly driven output bit through the use of reciprocating movement of a striker caused by means of a motion conversion member.

BACKGROUND OF THE INVENTION

Hammer drills are employed to do a task of, e.g., drilling a concrete structures. There arises such an instance that a screw is tightened to an anchor embedded into a hole formed by the drilling work. However, typical hammer drills are always accompanied by striking motion and therefore cannot be used in tightening the screw, which requires the additional use of an electric driver.

Also known in the art is a hammer drill of the type capable of releasing a striking motion and transmitting only a rotation force to an output bit. This type of hammer drill has no ability to tighten the screw with a suitable torque but tends to, not infrequently, tighten the screw too heavily.

In the meantime, Japanese Patent Laid-open Publication Nos. 2000-233306 and H7-1355 disclose a vibratory drill and an impact drill wherein a vibratory load or an impact load can be released and a tightening torque can be controlled using a tightening-torque adjusting clutch. However, no tightening-torque adjusting clutch has heretofore been employed in the hammer drills in which an axial striking force is applied against a rotatingly driven output bit through the use of an axially reciprocating striker. For this reason, the conventional hammer drills still require the use of an electric driver to perform the task of tightening a screw as noted above.

SUMMARY OF THE INVENTION

It is, therefore, an object of the present invention to provide a hammer drill that can deactivate axial striking motion and further can allow a user to control a screw tightening torque with the use of a tightening-torque adjusting clutch.

In accordance with the present invention, there is provided a hammer drill including: a motor; a spindle rotatingly driven by the motor and holding an output bit; a motion conversion member for converting rotational movement of the motor to reciprocating movement; a striker reciprocatingly driven by the motion conversion member for applying an axial striking force to the output bit; a striking-motion-releasing mechanism for releasing the striking force applying action exercised by the striker; and a tightening-torque adjusting clutch for interrupting the transfer of the rotational force to the output bit by increasing a load torque.

BRIEF DESCRIPTION OF THE DRAWINGS

The above and other objects and features of the present invention will become apparent from the following description of preferred embodiments, given in conjunction with the accompanying drawings, in which.

DETAILED DESCRIPTION OF THE PREFERRED EMBODIMENTS

Figure 1:
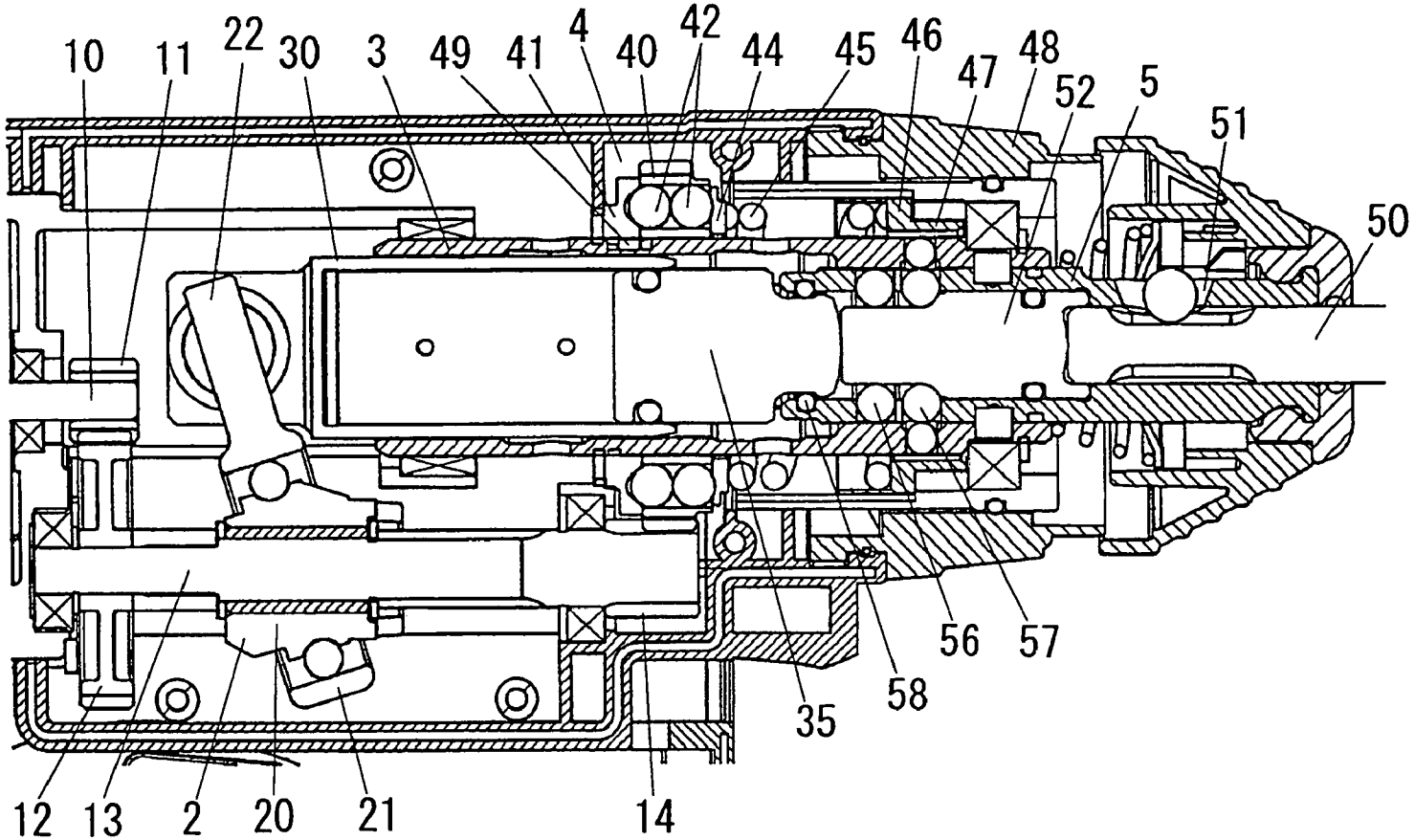
FIG. 1 is a vertical cross sectional view of a hammer drill in accordance with a first preferred embodiment of the present invention.

The present invention will now be described with reference to the embodiments illustrated in the accompanying drawings. In accordance with a first preferred embodiment of the present invention, a connecting shaft 13 is operatively connected to an output shaft 10 of a motor through gears 11 and 12, as shown in FIG. 1. The connecting shaft 13 is provided at its front end with a pinion 14 integrally formed therewith. A motion conversion member 2 is disposed at an intermediate part of the connecting shaft 13.

The motion conversion member 2 includes a rotating portion 20 affixed to and rotatable with the connecting shaft 13 as a unit, an outer race 21 rotatably fitted to an inclined surface of the rotating portion 20, and a rod 22 protruding from the outer race 21. The rod 22 is connected to a piston 30 that can be moved within a cylinder 3 along an axial direction thereof. As the connecting shaft 13 rotates, the rod 22 and the outer race 21 are subjected to oscillating movement because the connection of the rod 22 to the piston 30 restrains any rotation of the rod 22 and the outer race 21 relative to the connecting shaft 13. This reciprocates the piston 30 in an axial direction.

The cylinder 3 is rotatable about its axis, on the outer circumferential surface of which a rotating body 40 having a gear meshed with the pinion 14 of the connecting shaft 13 is coupled for sliding movement in an axial direction of the cylinder 3 and also for rotational movement with respect to the cylinder 3. At one side of the rotating body 40, a clutch plate 41 is secured to the cylinder 3 by means of a key 49.

The rotating body 40 is of a ring shape and has a plurality of axially penetrating holes into which steel balls 42 are received. A clutch spring 45 is disposed to press a ball retainer 44 against the steel balls 42. Pressing action of the clutch spring 45 brings the steel balls 42 into engagement with conical engaging recesses formed on the clutch plate 41.

During the time when the steel balls 42 retained in the holes of the rotating body 40 are engaged with the recesses of the clutch plate 41, the rotating body 40 rotates about the axis of the cylinder 3 together with the clutch plate 41 as a unit, thereby ensuring that the rotational force of the connecting shaft 13 is transmitted to the cylinder 3 through the rotating body 40 and the clutch plate 41.

The clutch spring 45 that makes contact with the ball retainer 44 at one end is supported at the other end by means of a movable plate 46 lying around the outer periphery of the cylinder 3. Along with the rotation of a clutch handle 48, the movable plate 46 can be moved in an axial direction of the cylinder 3 to thereby change the level of compression of the clutch spring 45.

A spindle 5 is attached to an axial front end of the cylinder 3 for unitary rotation with the cylinder 3. The spindle 5 is provided at its axial front end with a chuck portion 51 for holding an output bit 50 in such a manner that the output bit 50 can be rotated with the chuck portion 51 as a unit and also can be slid axially within a limited range of movement.

Figure 2:
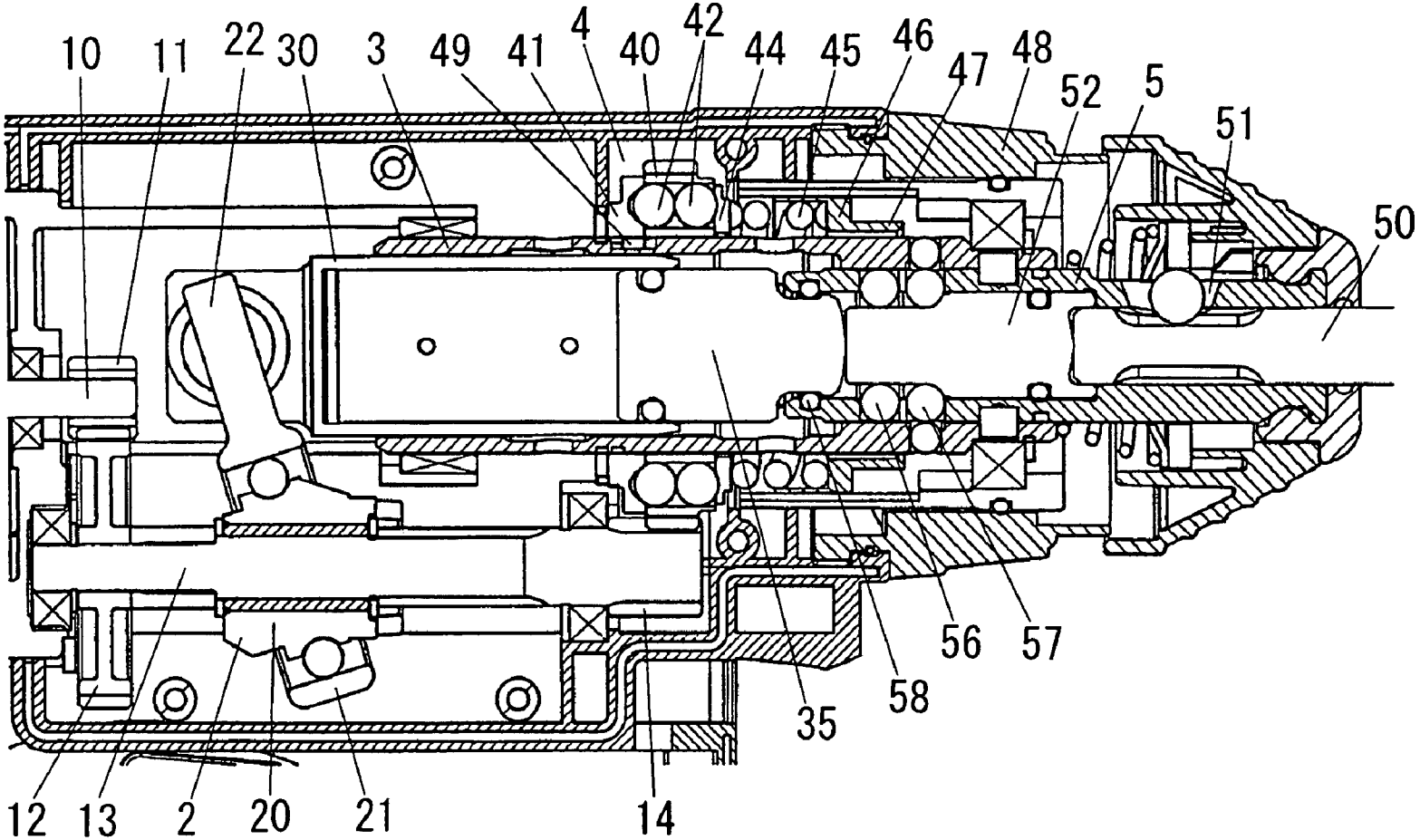
FIG. 2 is a vertical cross sectional view of the hammer drill shown in FIG. 1, which is set in a striking-motion-activated mode.
Figure 3:
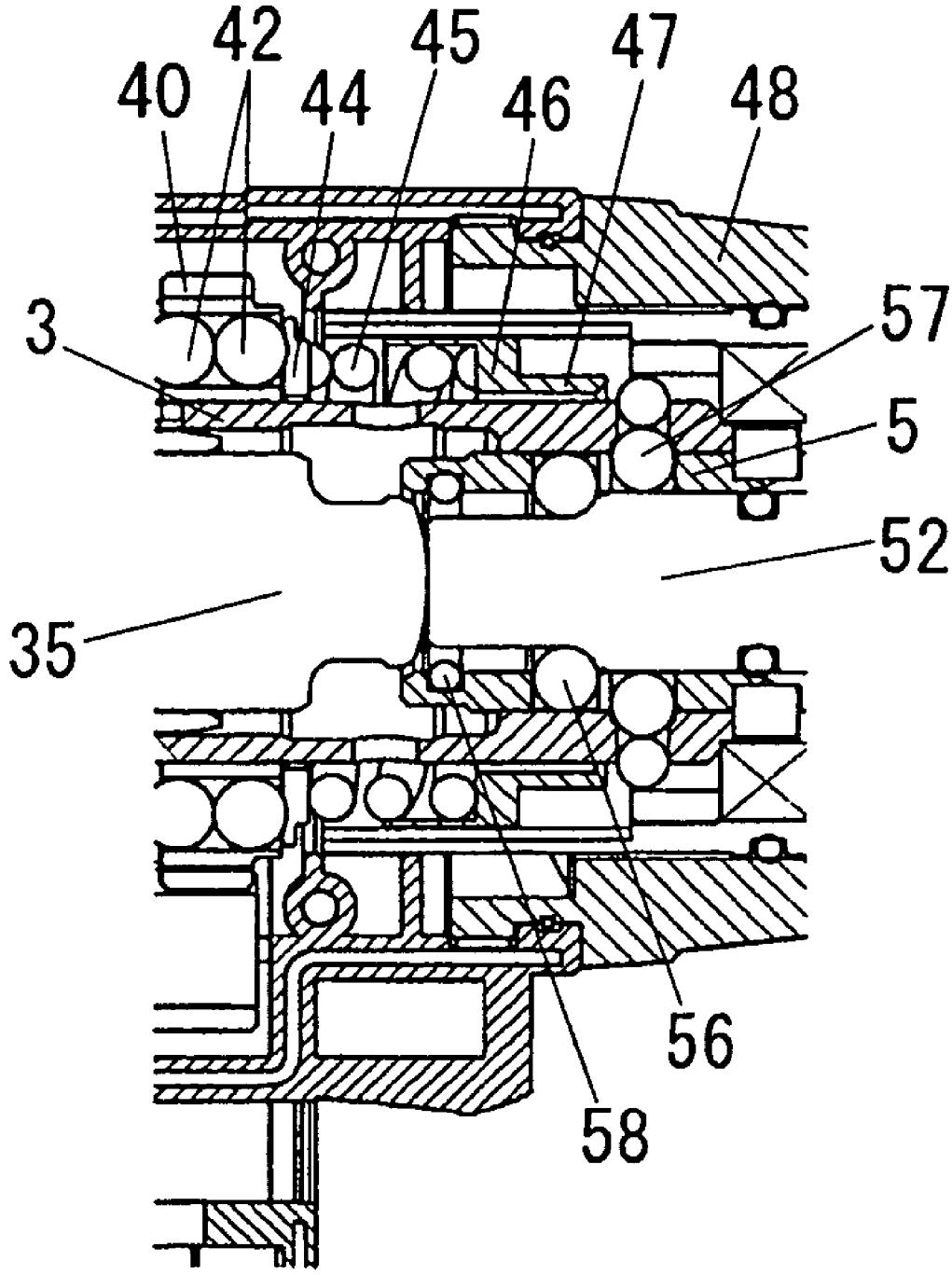
FIG. 3 is a partially cut-away vertical cross sectional view of the hammer drill shown in FIG. 1, which is set in a striking-motion-activated mode.

The spindle 5 is further provided with a ball 56 for preventing any backward removal of an intermediate member 52, which is retained within the spindle 5 in an axially slidable manner, and a ball 57 for restraining the retractable movement of the intermediate member 52 at a position in front of the ball 56. As shown in FIG. 1, the ball 57 serves to restrain the retracting movement of the intermediate member 52 only when a restraint piece 47 integrally formed with the movable plate 46 lies around the ball 57. If the clutch handle 48 is turned to retract the movable plate 46 and hence to remove the restraint piece 47 from around the ball 57 as illustrated in FIG. 2, the intermediate member 52 whose front end remains in contact with the rear end of the output bit 50 pushes the ball 57 radially outwardly, as the output bit 50 is pressed against a drilling object member, and then moves rearwards into contact with the removal-preventing ball 56 as depicted in FIG. 3.

The piston 30 is of a cylindrical shape having a closed rear end and an opened front end. A striker 35 is slidably received within the piston 30. As the piston 30 makes reciprocating movement, the striker 35 is also caused to reciprocate, at which time the air within the space of the piston 30 enclosed by the striker 35 plays a role of an air spring. Disposed on the inner circumference of the rear end portion of spindle 5 is an O-ring 58 that resiliently engages with the outer circumference of the front end portion of the striker 35 to prevent backward movement of the striker 35.

The backward movement of the intermediate member 52 is restrained under the condition illustrated in FIG. 1, namely, in the event that the restraint piece 47 of the movable plate 46 is placed around the ball 57. Furthermore, in the condition that the striker 35 is retained at the rear end portion of the spindle 5, the rotational force of the motor is transmitted from the connecting shaft 13 to the cylinder 3 via the rotating body 40 and the clutch plate 41 and then transferred from the cylinder 3 to the output bit 50 through the spindle 5.

Concurrently, the rotational movement of the connecting shaft 13 is converted to reciprocating movement of the piston 30 by virtue of the motion conversion member 2. At this moment, the striker 35 is kept retained by the spindle 5, for the reason of which the striker 35 does not make any reciprocating movement and therefore only the rotational force is applied to the output bit 50.

At the time when a task of tightening, e.g., a screw, using the rotating output bit 50, if the load torque becomes greater than the engaging force between the steel balls 42 and the recesses of the clutch plate 41 caused by the clutch spring 45, the steel balls 42 are escaped from the recesses thus inhibiting any transfer of the rotational force of the rotating body 40 to the clutch plate 41 (cylinder 3). This restrains the tightening torque.

The tightening torque can be increased by turning the clutch handle 48 in the manner as set fort above so that the movable plate 46 can be moved backward to increase the level of compression of the clutch spring 45. This means that the rotating body 40 and the clutch plate 41 cooperate with the steel balls 42, the movable plate 46 and the clutch spring 45 to form a tightening-torque adjusting clutch 4. In addition, spherical recesses are formed on the portions of the ball retainer 44 with which the steel balls 42 make rolling contact.

Figure 4:
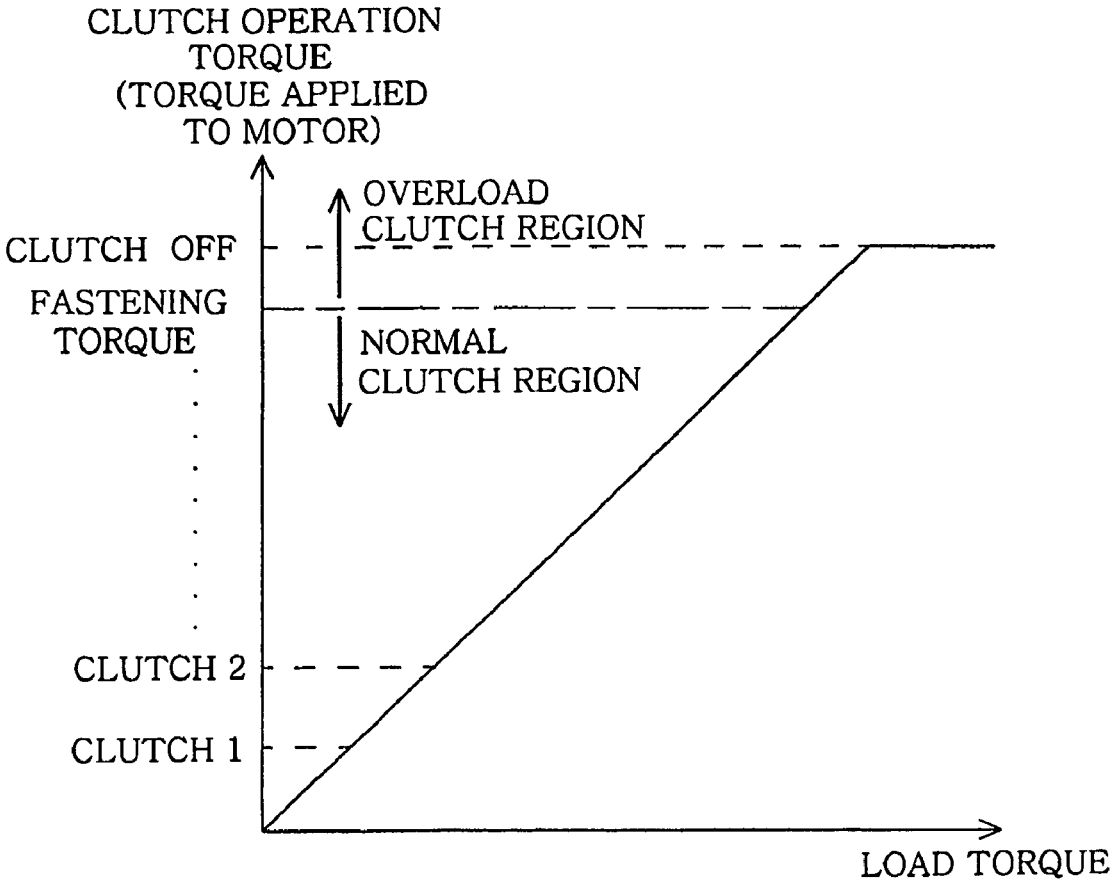
FIG. 4 graphically represents the characteristics of a clutch employed in the hammer drill shown in FIG. 1.

If the restraint piece 47 is removed from around the ball 57 by the backward movement of the movable plate 46 as shown in FIG. 2, the output bit 50 and the intermediate member 52 are moved backward, as the output bit 50 is pressed against the drilling object member, to thereby push the striker 35 in a rearward direction as can be seen in FIG. 3. Thus, the reciprocating movement of the piston 30 leads to the reciprocating movement of the striker 35, which means that the striker 35 is in condition for applying a striking force to the output bit 50 in an axial direction through the intermediate member 52. Moreover, at the time when the restraint piece 47 (movable plate 46) has been moved backward into the above-noted position, the tightening-torque adjusting clutch 4 is designed to have a fastening torque greater than the motor stalling torque, meaning that the tightening-torque adjusting clutch 4 constitutes an overload clutch (see FIG. 4).

Figure 7A:
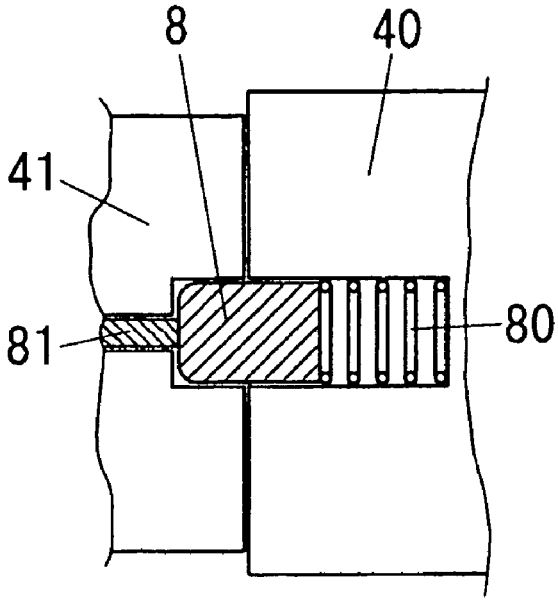
FIGS. 7A and 7B are cross sectional views illustrating operations of a coupling portion in the tightening-torque adjusting clutch of the hammer drill shown in FIG. 5.
Figure 7B:
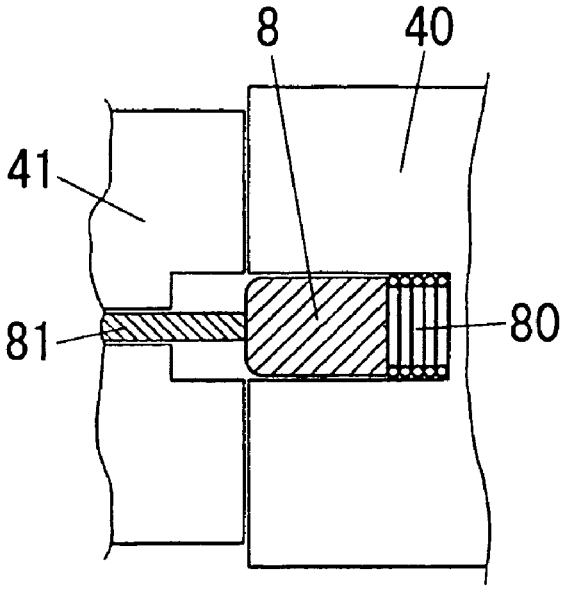
Figure 8:
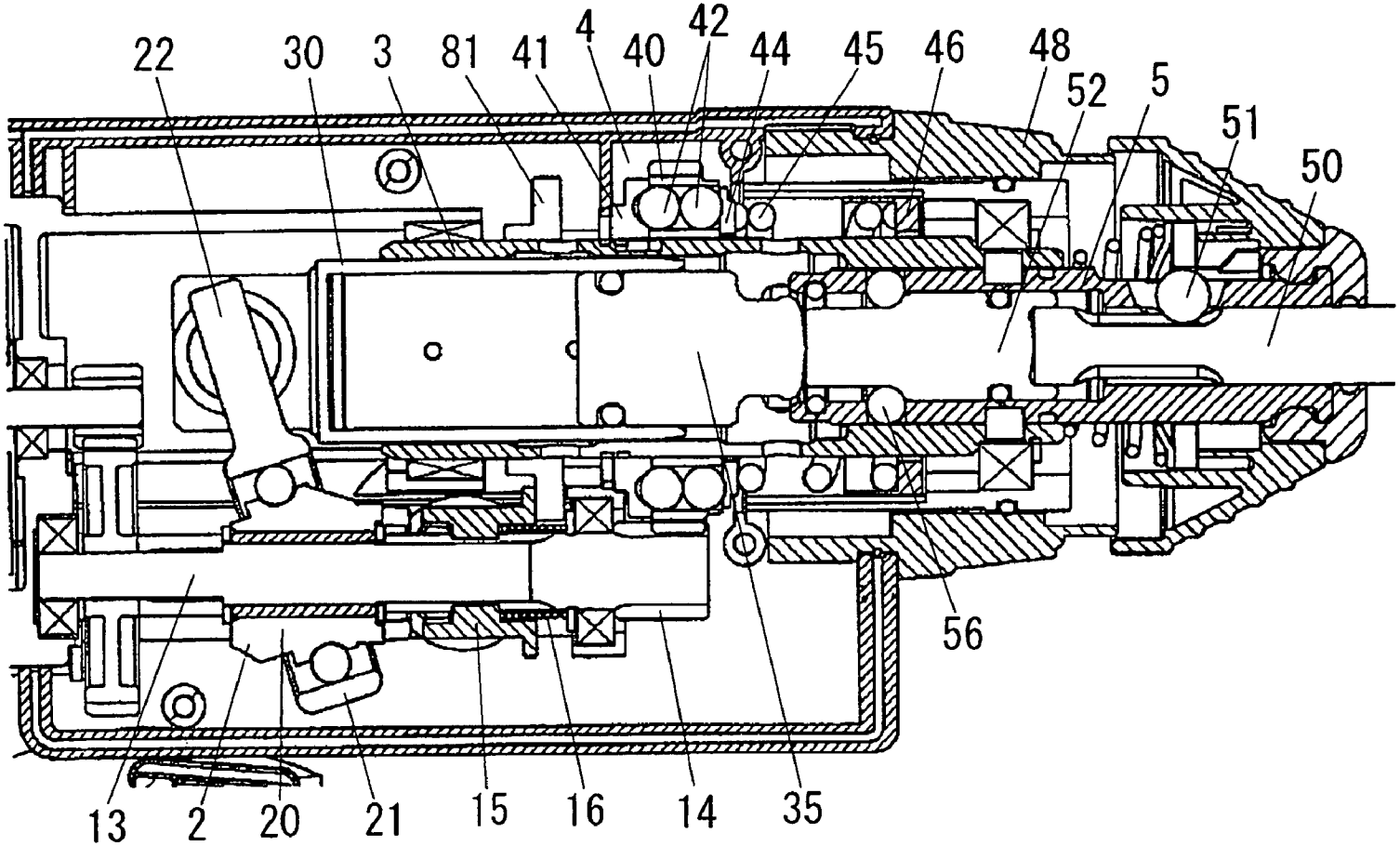
FIG. 8 is a vertical cross sectional view of the hammer drill shown in FIG. 5, which is set in a striking-motion-deactivated mode.
Figure 9A:
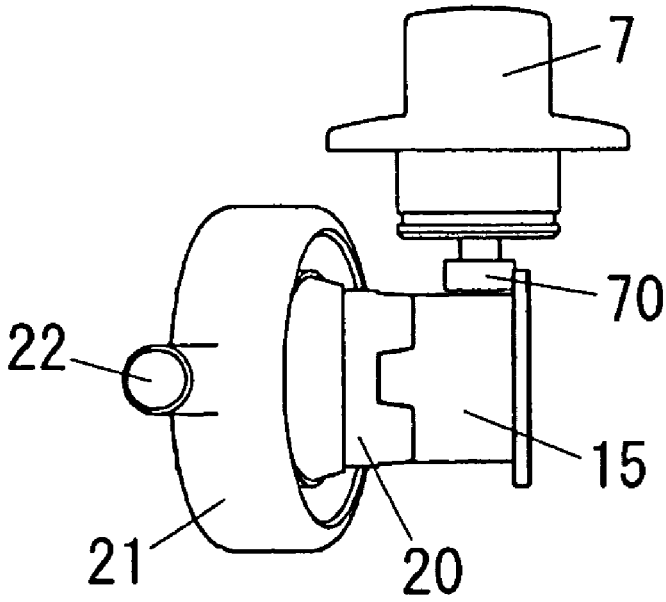
FIG. 9A is a top view showing a switching handle, a collar and a motion conversion part in one operative condition
Figure 9B:
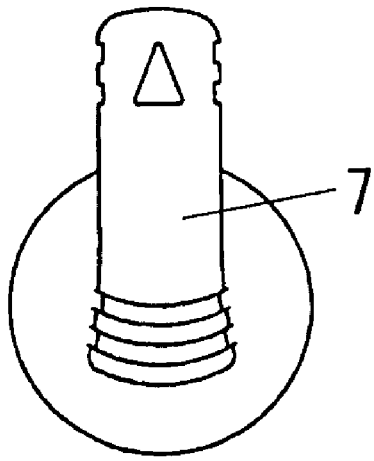
FIG. 9B is a front elevational view illustrating the switching handle.
Figure 10A:
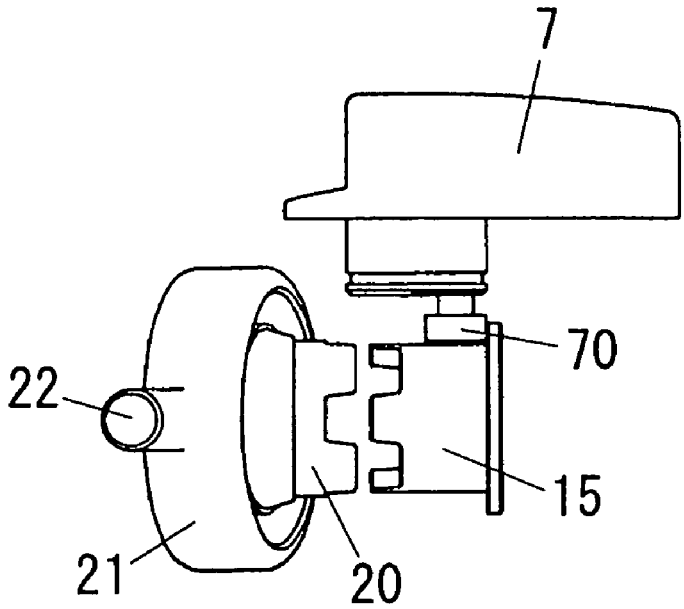
FIG. 10A is a top view showing the switching handle, the collar and the motion conversion part in another operative condition
Figure 10B:
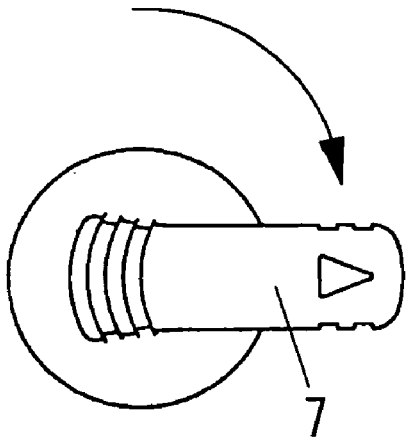
FIG. 10B is a front elevational view illustrating the switching handle.

FIGS. 5 through 11 show a hammer drill in accordance with a second preferred embodiment of the present invention. Although the striking-motion-deactivated mode where no striking force is applied to the output bit 50 is attained by restraining the movement of the striker 35 in the first preferred embodiment, the same mode is accomplished in the second preferred embodiment by way of interrupting the rotational force transmitted from the connecting shaft 13 to the motion conversion member 2. More specifically, the rotating portion 20 of the motion conversion member 2 is made rotatable with respect to the connecting shaft 13. A collar 15 that cooperates with the rotating portion 20 to form an engaging clutch is provided such that the collar 15 can be rotated with the connecting shaft 13 as a unit and also can be slid in an axial direction with respect to the connecting shaft 13. The collar 15 is normally pressed against the rotating portion 20 by means of a spring 16 so that it can be engaged with the rotating portion 20 to transfer the rotational force of the connecting shaft 13 to the rotating portion 20. If the collar 15 is displaced away from the rotating portion 20 against the biasing force of the spring 16 as illustrated in FIG. 8, no rotational force is transmitted to the rotating portion 20, as a result of which the cylinder 3 is kept from any reciprocating movement and hence no striking force is applied to the output bit 50.

Referring to FIGS. 9A through 10B, the movement of the collar 15 is caused by manipulating a switching handle 7 exposed to the outside. In the drawings, reference numeral 70 designates a cam roller of the switching handle 7 for driving the collar 15.

In accordance with the second preferred embodiment, a striking-motion-activated mode can be shifted to a striking-motion-deactivated mode and vice versa regardless of the tightening torque adjusted. Thus, the hammer drill of the second preferred embodiment includes a mechanism for making the tightening-torque adjusting function inoperative in the striking-motion-activated mode by directly connecting the rotation transfer members through the use of the tightening-torque adjusting clutch 4.

The mechanism includes a pin 8 for directly coupling the rotating body 40 serving as a driving member to the clutch plate 41 functioning as a driven member, a spring 80 for pressing the pin 8 toward a position where the direct coupling takes place, and a conversion plate 81 for pushing the pin 8 against the spring 80 into a release position where the direct coupling is released. In the illustrated embodiment, the conversion plate 81 is adapted to interlock with the movement of the collar 15.

Figure 5:
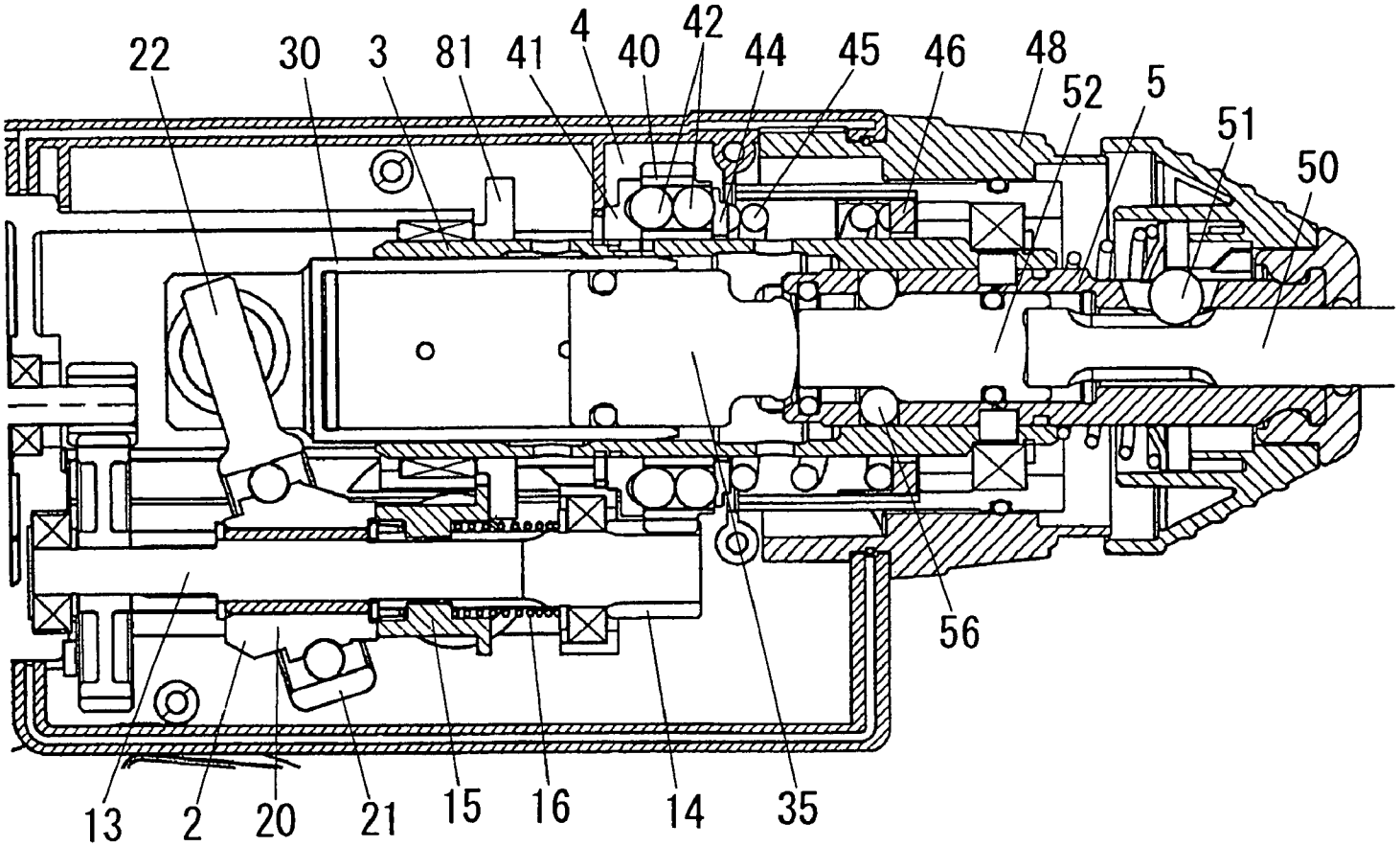
FIG. 5 is a vertical cross sectional view of a hammer drill in accordance with a second preferred embodiment of the present invention, which is set in a striking-motion-activated mode.
Figure 6:
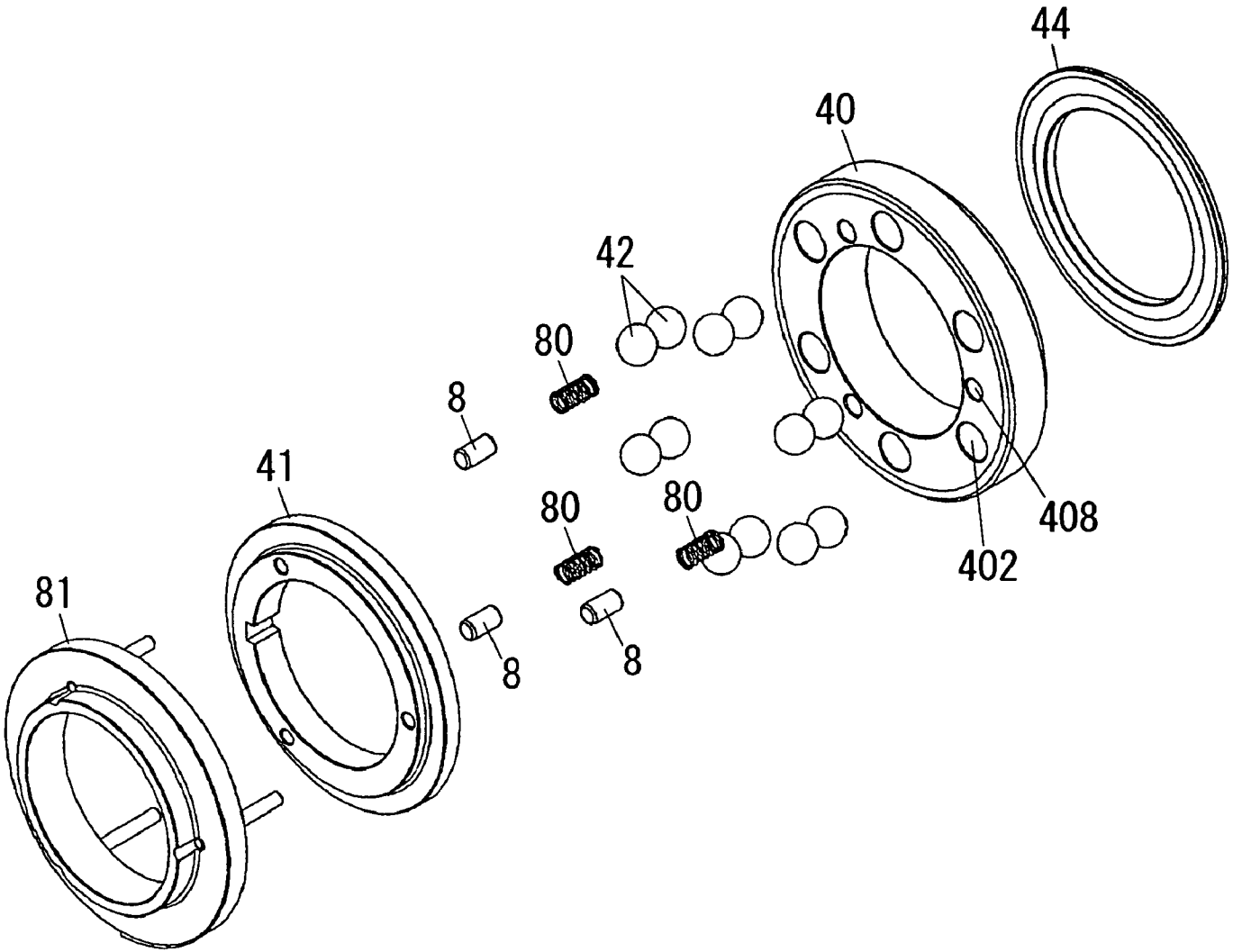
FIG. 6 is an exploded perspective view illustrating a tightening-torque adjusting clutch of the hammer drill shown in FIG. 5.

Specifically, in order to have the collar 15 engaged with the rotating portion 20 to perform the striking motion in concert with the rotating motion as depicted in FIG. 5, the conversion plate 81 is caused to move backward so that the rotating body 40 and the clutch plate 41 can be directly coupled by means of the pin 8 as can be seen in FIG. 7A. If the collar 15 is displaced frontward out of engagement with the rotating portion 20, the conversion plate 81 is pressed by the collar 15 such that the rotating body 40 and the clutch plate 41 can make relative movement as illustrated in FIG. 7B.

Figure 11:
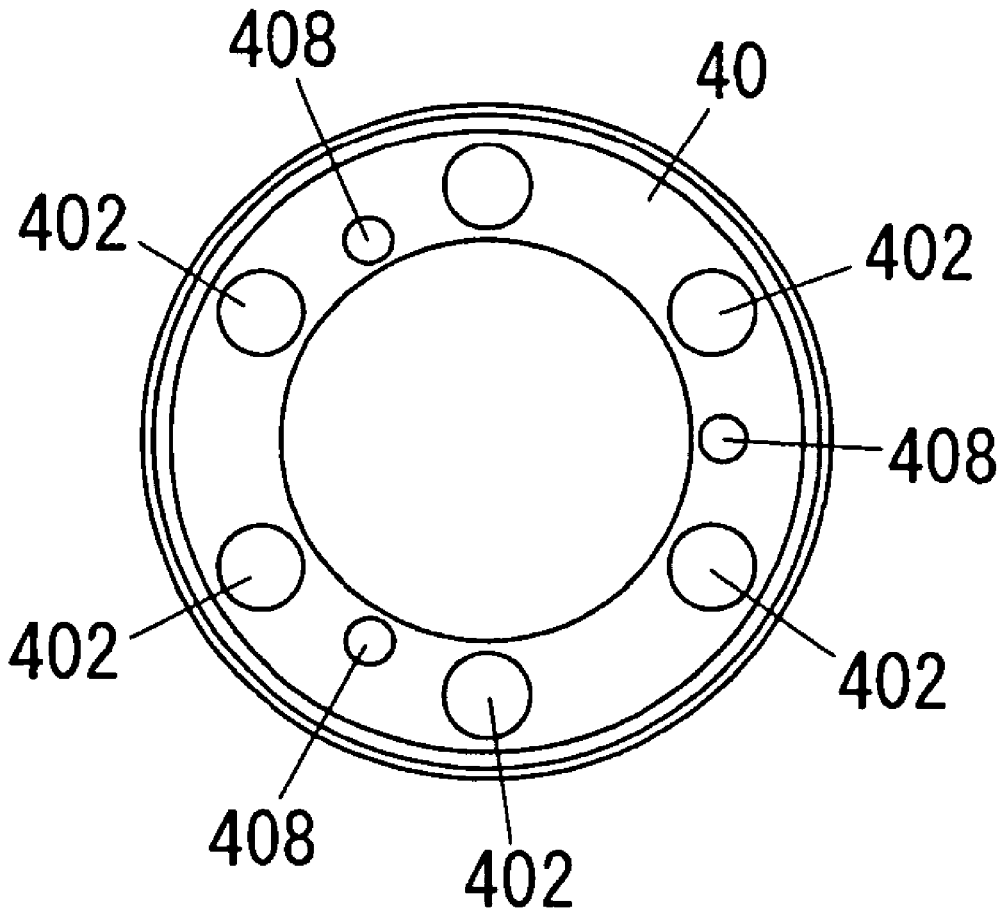
FIG. 11 is a front elevational view showing a rotating body in the tightening-torque adjusting clutch of the hammer drill shown in FIG. 5.
Figure 12:
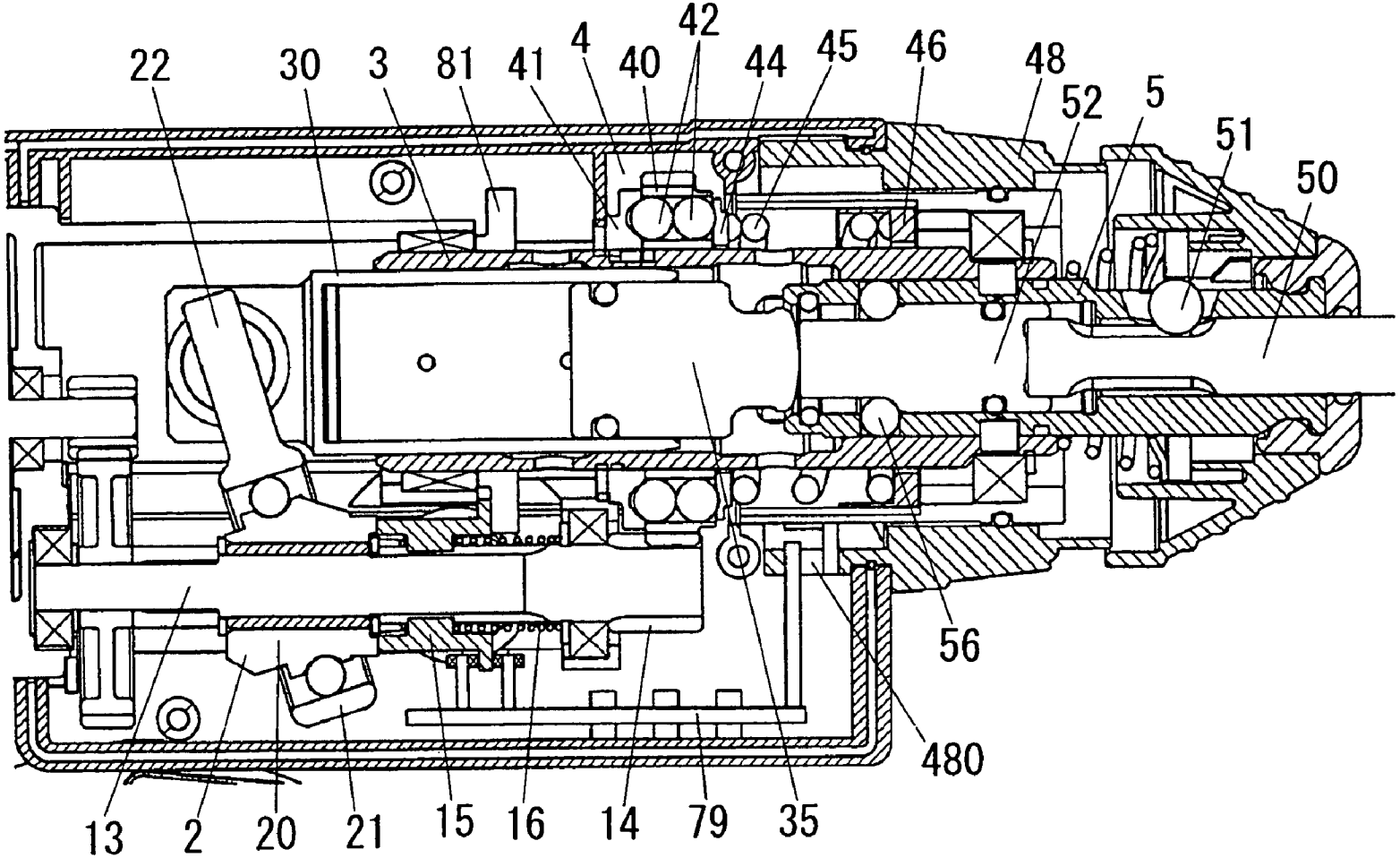
FIG. 12 is a vertical cross sectional view of a hammer drill in accordance with a third preferred embodiment of the present invention, which is set in a striking-motion-activated mode.
Figure 13:
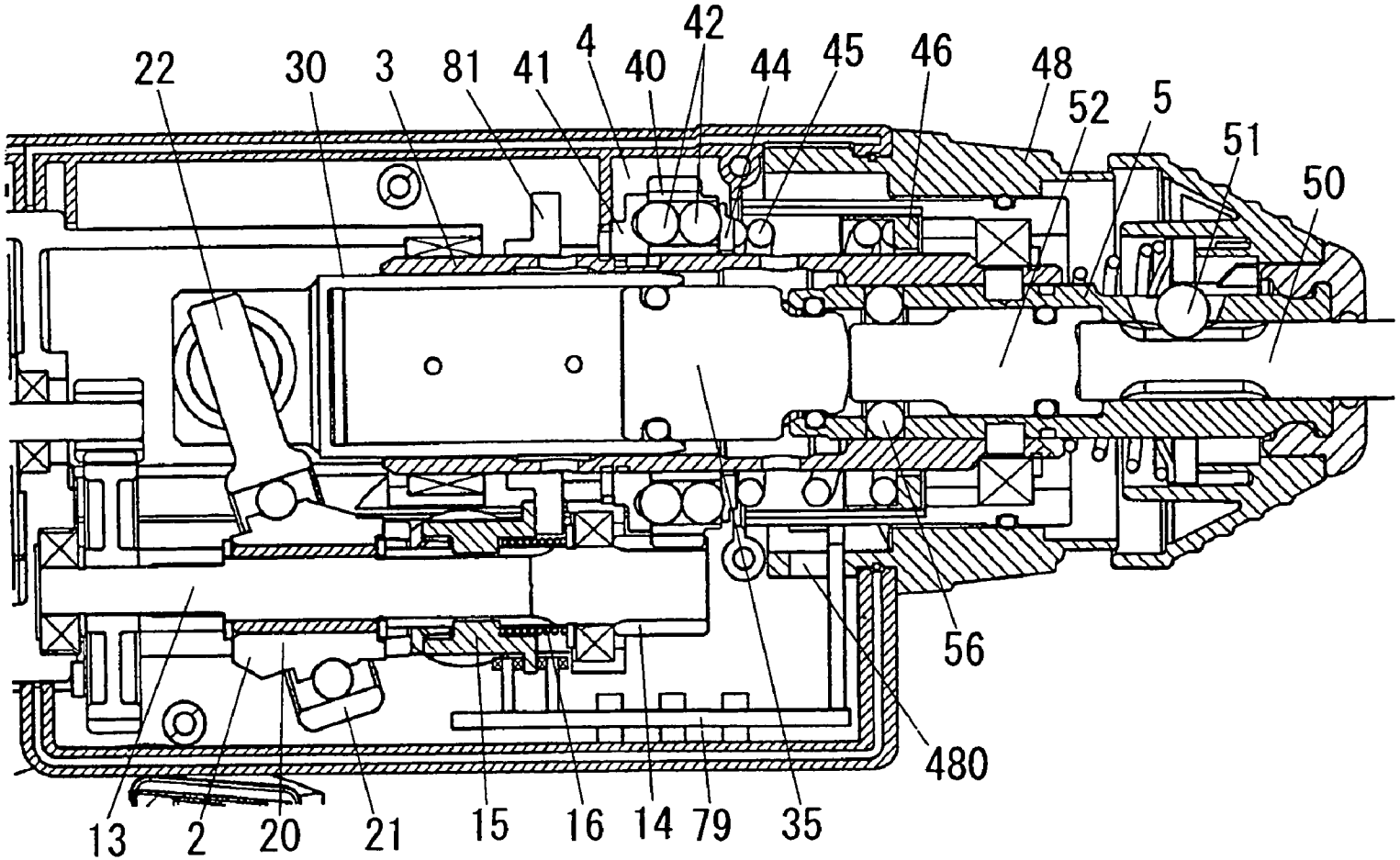
FIG. 13 is a vertical cross sectional view of the hammer drill shown in FIG. 12, which is set in a striking-motion-deactivated mode.
Figure 14:
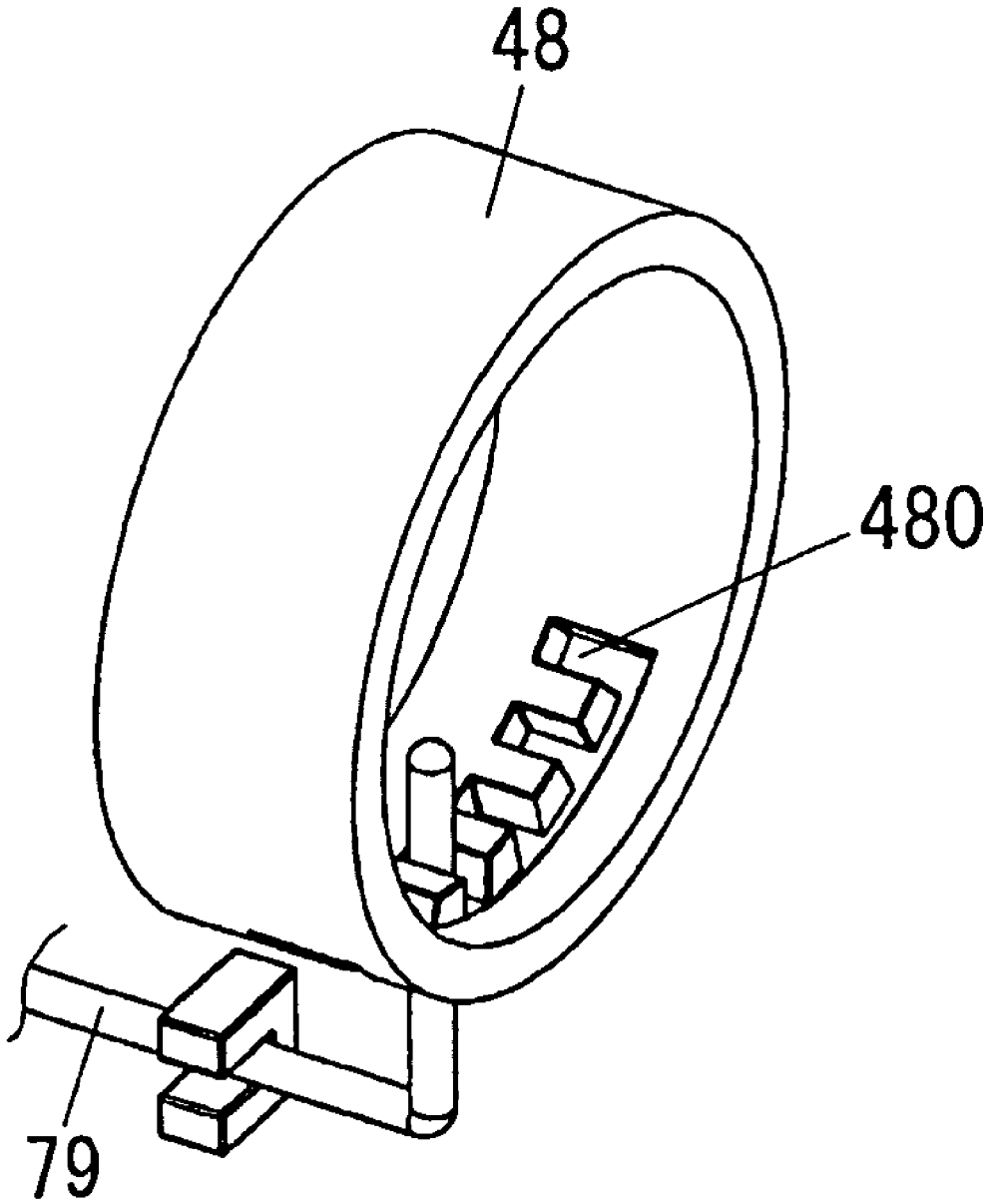
FIG. 14 is a perspective view illustrating a clutch handle and a lever of the hammer drill shown in FIG. 12.
Figure 15:
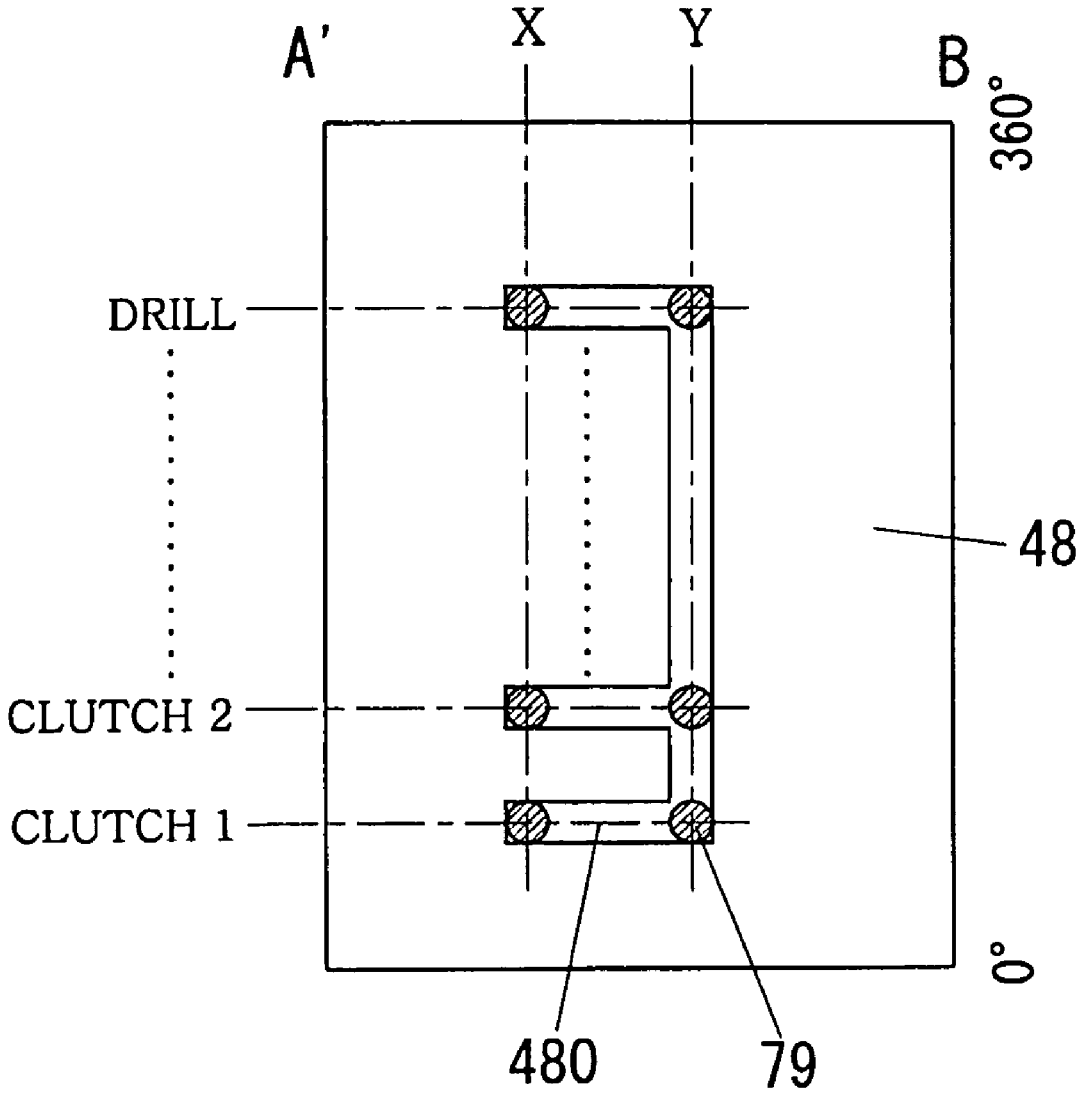
FIG. 15 is a developed view illustrating an engagement groove of the clutch handle of the hammer drill shown in FIG. 12.

The holes 402 formed through the rotating body 40 for receiving the steel balls 42 have a pitch circle differing from that of the holes 408 for accommodating the pin 8 and the spring 80 as clearly shown in FIG. 11. This prevents the pin 8 from any removal out of the engaging recesses of the clutch plate 41.

FIGS. 12 through 15 illustrate a hammer drill in accordance with a third preferred embodiment of the present invention. The third preferred embodiment is the same as the second preferred embodiment in that the striking-motion-deactivated mode (see FIG. 13) is attained by interrupting the transfer of the rotational force between the rotating portion 20 and the collar 15, both of which cooperate to form an engaging clutch, and further in that the rotating body 40 and the clutch plate 41 of the tightening-torque adjusting clutch are directly coupled to each other by means of the pin 8 in the striking-motion-activated mode, i.e., hammer drill mode, (see FIG. 12). In accordance with the third preferred embodiment, however, a lever 79 is provided that interlocks with the axial movement of the collar 15. One end of the lever 79 is brought into engagement with an engaging groove 480 provided on the clutch handle 48.

In this regard, the engaging groove 480 is of a comb-like shape, i.e., has a portion extending in a circumferential direction of the clutch handle 48 and a plurality of axially extending portions. In the striking-motion-activated mode, i.e., hammer drill mode, the lever 79 enters one of the axially extending portions ("X" in FIG. 15) of the engaging groove 480 and locks up the clutch handle 48 against any manipulation. In the striking-motion-deactivated mode, the lever 79 is positioned in the circumferentially extending portion ("Y" in FIG. 15) of the engaging groove 480, thereby allowing the clutch handle 48 to be manually turned and making it possible to adjust the tightening torque.

Figure 16:
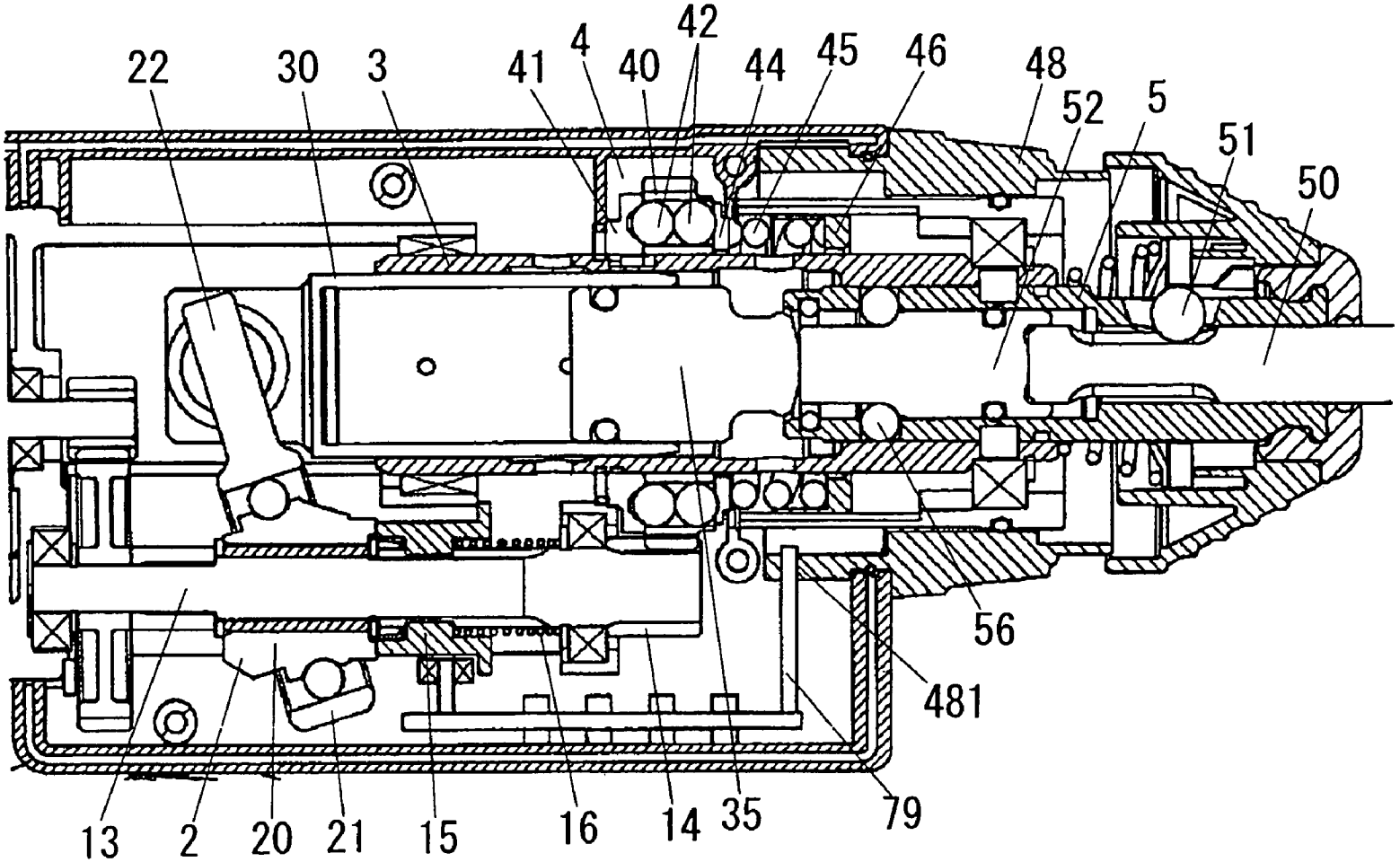
FIG. 16 is a vertical cross sectional view of a hammer drill in accordance with a fourth preferred embodiment of the present invention, which is set in a striking-motion-activated mode.
Figure 17:
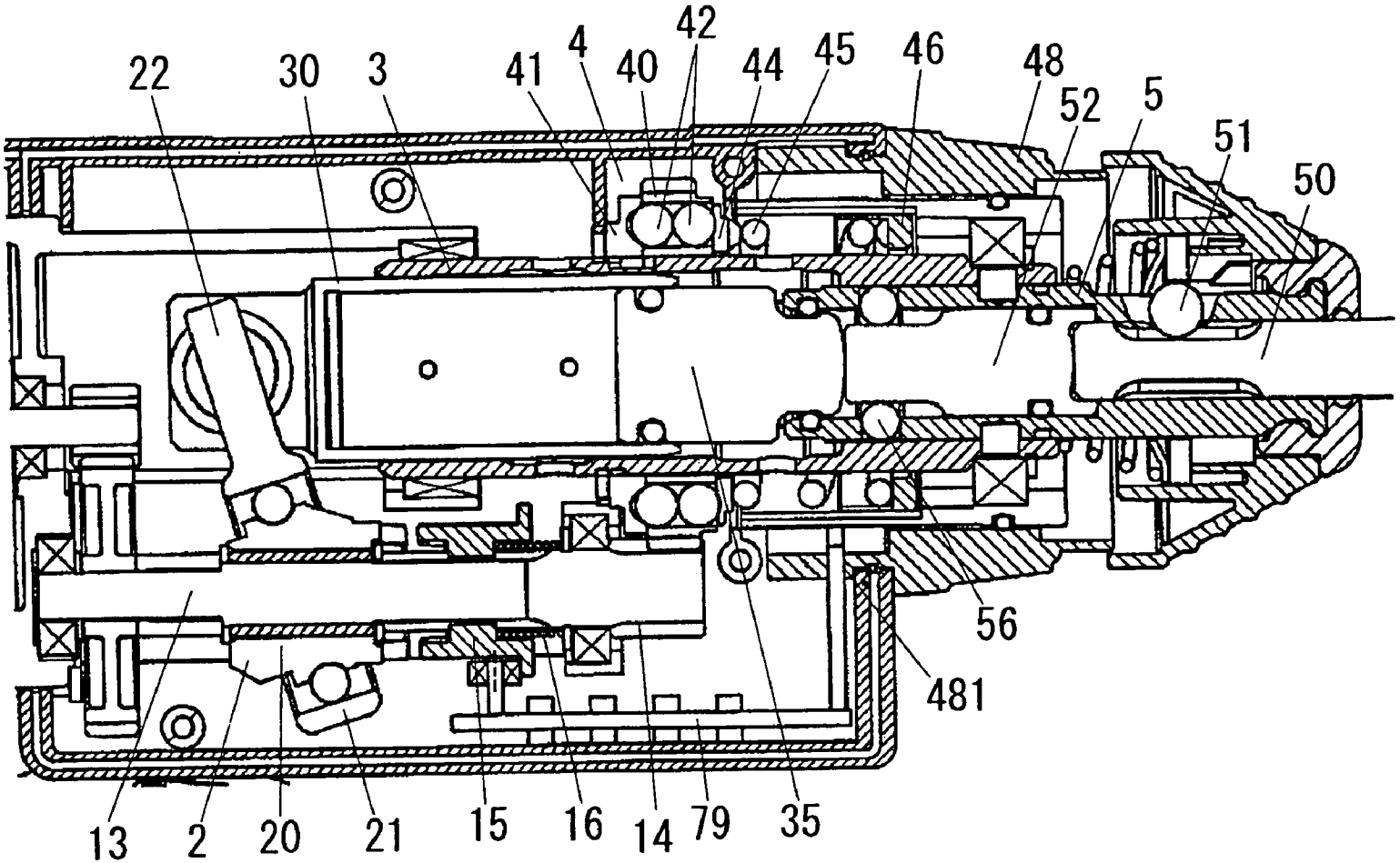
FIG. 17 is a vertical cross sectional view of the hammer drill shown in FIG. 16, which is set in a striking-motion-deactivated mode.
Figure 18:
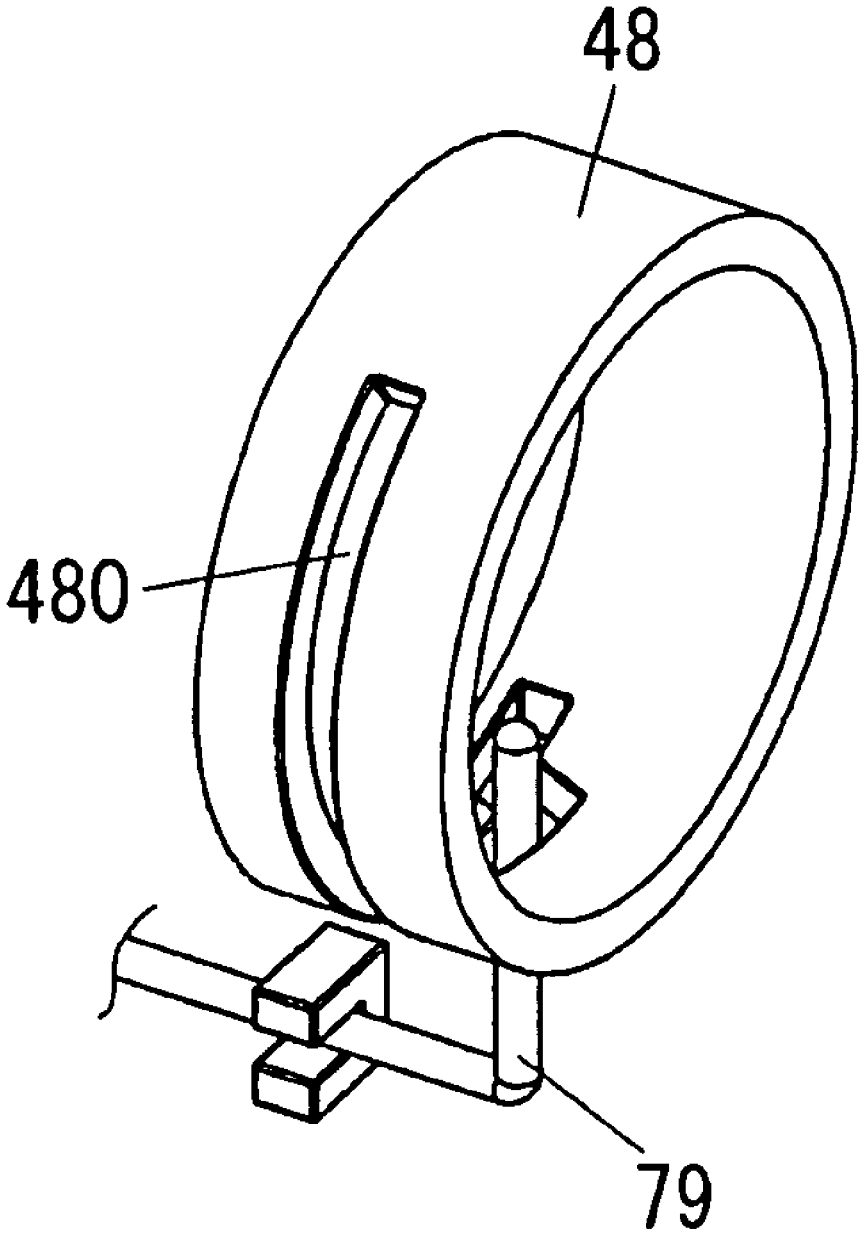
FIG. 18 is a perspective view illustrating a clutch handle and a lever of the hammer drill shown in FIG. 16.
Figure 19:
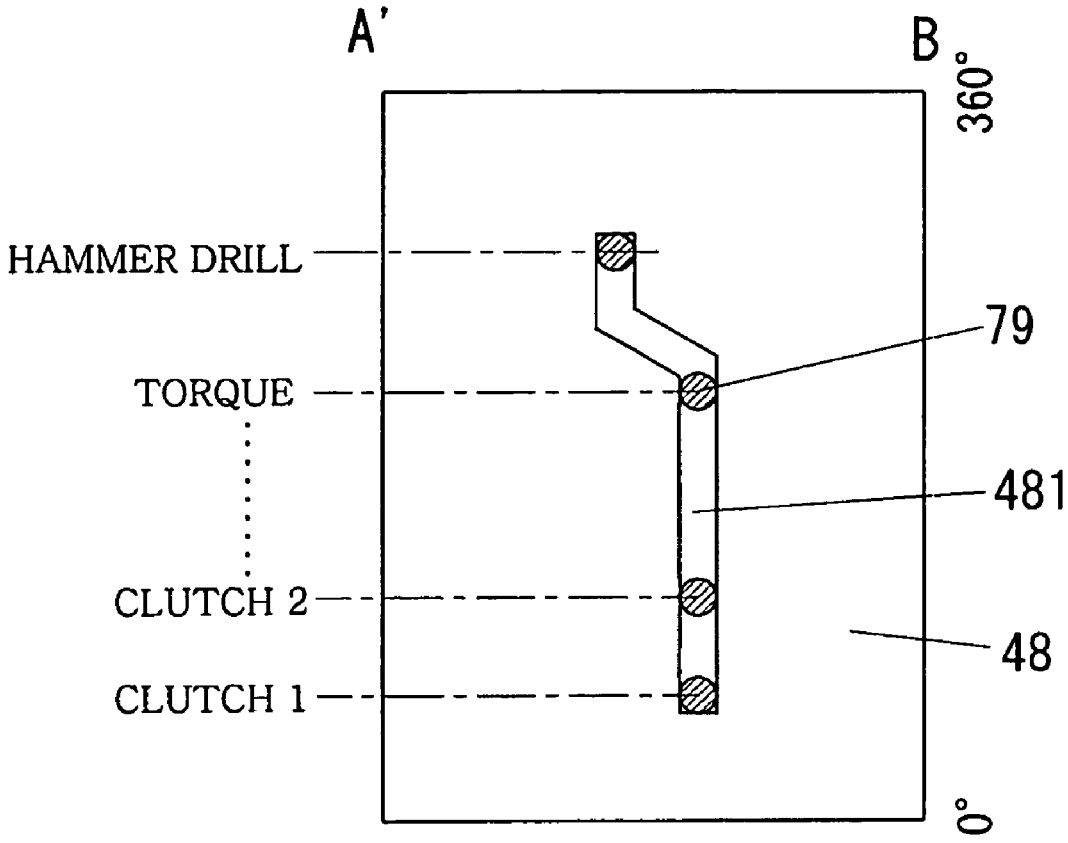
FIG. 19 is a developed view illustrating a cam groove of the clutch handle of the hammer drill shown in FIG. 16.

FIGS. 16 through 19 illustrate a hammer drill in accordance with a fourth preferred embodiment of the present invention. The transfer of the rotational force between the rotating portion 20 and the collar 15 both forming the engaging clutch is interrupted in response to the manipulation of the clutch handle 48. The clutch handle 48 has a cam groove 481 with which one end of the lever 79 is engaged. Under a tightening torque adjustable condition, the lever 79 causes the collar 15 to be displaced away from the rotating portion 20 as illustrated in FIG. 17, thus inhibiting the reciprocating movement of the piston 30. In contrast, under a condition that the clutch handle 48 is turned to compress the clutch spring 45 to the maximum extent as shown in FIG. 16, the collar 15 is engaged with the rotating portion 20 to thereby transfer the rotational force to the motion conversion member 2. This results in the striking-motion-activated mode, i.e., hammer drill mode, where the striking force as well as the rotational force is applied to the output bit 50. At this time, the steel balls 42 are not allowed to move away from the clutch plate 41 against the pressing force of the clutch spring 45, for the reason of which the rotational force is transferred to the output bit 50 regardless of the load torque.

Figure 25A:
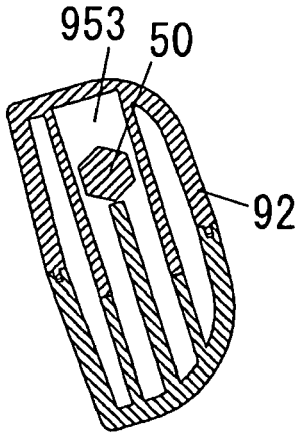
FIGS. 25A through 25D are cross sectional views taken along lines 25A-25A, 25B-25B, 25C-25C and 25D-25D in FIG. 24, respectively.
Figure 25B:
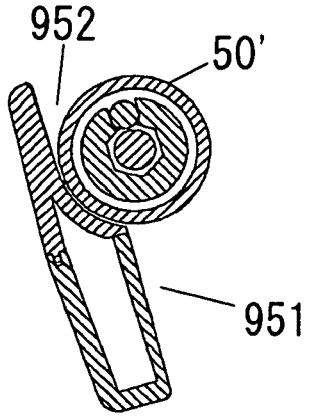
Figure 25C:
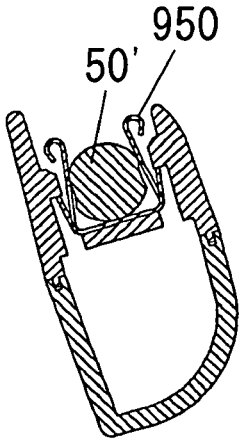
Figure 25D:
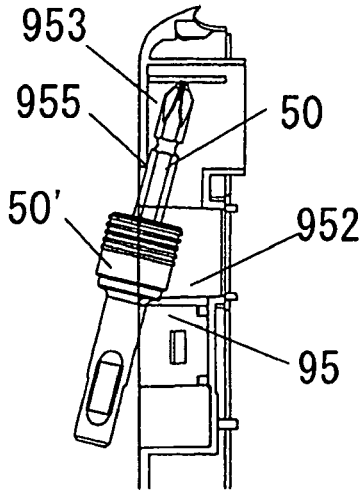
Figure 26:
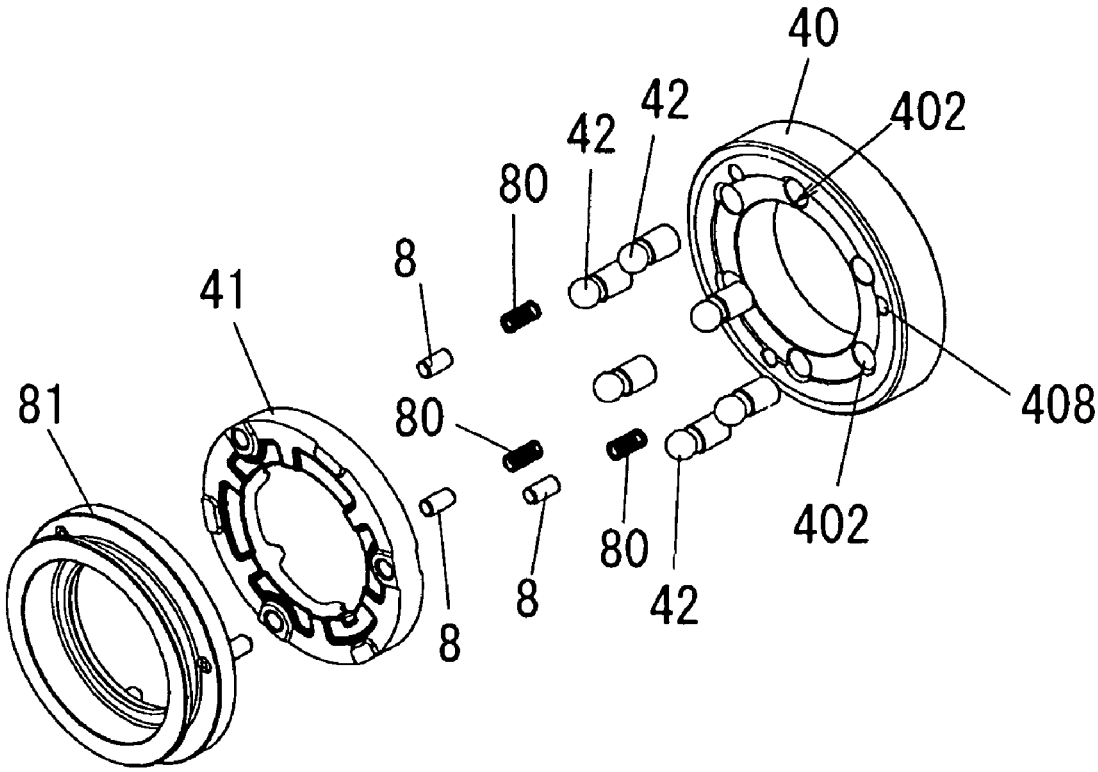
FIG. 26 is an exploded perspective view illustrating a tightening-torque adjusting clutch of the hammer drill shown in FIG. 20.

FIGS. 20 through 28 illustrate a hammer drill in accordance with a fifth preferred embodiment of the present invention. The hammer drill of the fifth preferred embodiment is the same as that shown in FIGS. 5 through 11 in basic aspects. Description will be given in order regarding the hammer drill of this preferred embodiment. Reference numeral 9 in the drawings designates a housing with which a grip portion 90 is formed integrally so as to extend downwardly therefrom. A battery pack 91 is detachably attached to the bottom of the grip portion 90. A housing-reinforcing connecting portion 92 is integrally formed between the bottom frontal end of the grip portion 90 and the front end of the housing 9. Reference numeral 93 in the drawings designates a trigger switch disposed at a bottom portion of the grip portion 90. Disposed within the rear end portion of the housing 9 is a motor 19 that can be activated or deactivated by the actuation of the trigger switch 93 and also can change its direction of rotation in response to the manipulation of a direction-changing lever 94. FIG. 26 is an exploded perspective view illustrating the tightening-torque adjusting clutch 4 employed in the hammer drill of the fifth preferred embodiment.

The connecting shaft 13 is operatively connected to an output shaft 10 of the motor 19 through gears 11 and 12. The connecting shaft 13 is provided at its front end with the pinion 14 integrally formed therewith. The motion conversion member 2 is disposed at an intermediate part of the connecting shaft 13. The motion conversion member 2 includes the rotating portion 20 affixed to and rotatable with the connecting shaft 13 as a unit, the outer race 21 rotatably fitted to an inclined surface of the rotating portion 20, and the rod 22 protruding from the outer race 21. The rod 22 is connected to the piston 30 that can be moved within the cylinder 3 along an axial direction.

The collar 15 that forms the engaging clutch in cooperation with the rotating portion 20 is provided on the connecting shaft 13 in such a fashion that the collar 15 can rotate with the connecting shaft 13 as a unit and also can be slid in an axial direction with respect to the connecting shaft 13. The collar 15 is pressed against the rotating portion 20 by means of the spring 16 into engagement with the rotating portion 20 to thereby transfer the rotational force of the connecting shaft 13 to the rotating portion 20. As the rotating portion 20 makes rotational movement, the rod 22 and the outer race 21 whose rotation about the connecting shaft 13 is restrained by the connection to the piston 30 are subjected to oscillating movement. This causes the piston 30 to reciprocate in its axial direction.

If the switching handle 7 (see FIG. 24) disposed on a flank side of the housing 9 is manipulated, the collar 15 moves forward against the spring 16 and is disengaged from the rotating portion 20. Under this condition, no rotational force is transferred to the rotating portion 20 and no reciprocating movement is induced in the piston 30.

The cylinder 3 is rotatable about it axis, on the outer circumferential surface of which the rotating body 40 having a gear meshed with the pinion 14 of the connecting shaft 13 is coupled for sliding movement in an axial direction of the cylinder 3 and also for rotational movement with respect to the cylinder 3. At one side of the rotating body 40, the clutch plate 41 is secured to the cylinder 3.

The rotating body 40 is of a ring shape and has a plurality of axially penetrating holes into which the steel balls 42 are received. The clutch spring 45 is disposed to press a ball retainer (thrust plate) 44 against the steel balls 42. Pressing action of the clutch spring 45 brings the steel balls 42 into engagement with conical engaging recesses formed on the clutch plate 41.

During the time when the steel balls 42 retained in the holes of the rotating body 40 are engaged with the recesses of the clutch plate 41, the rotating body 40 rotates about the axis of the cylinder 3 together with the clutch plate 41 as a unit, thereby ensuring that the rotational force of the connecting shaft 13 is transmitted to the cylinder 3 through the rotating body 40 and the clutch plate 41. The clutch spring 45 that makes contact with the ball retainer 44 at one end is supported at the other end by means of a movable plate 46 lying around the outer periphery of the cylinder 3. Along with the rotation of the clutch handle 48, the movable plate 46 can be moved in an axial direction of the cylinder 3 to thereby change the level of compression of the clutch spring 45.

Figure 22:
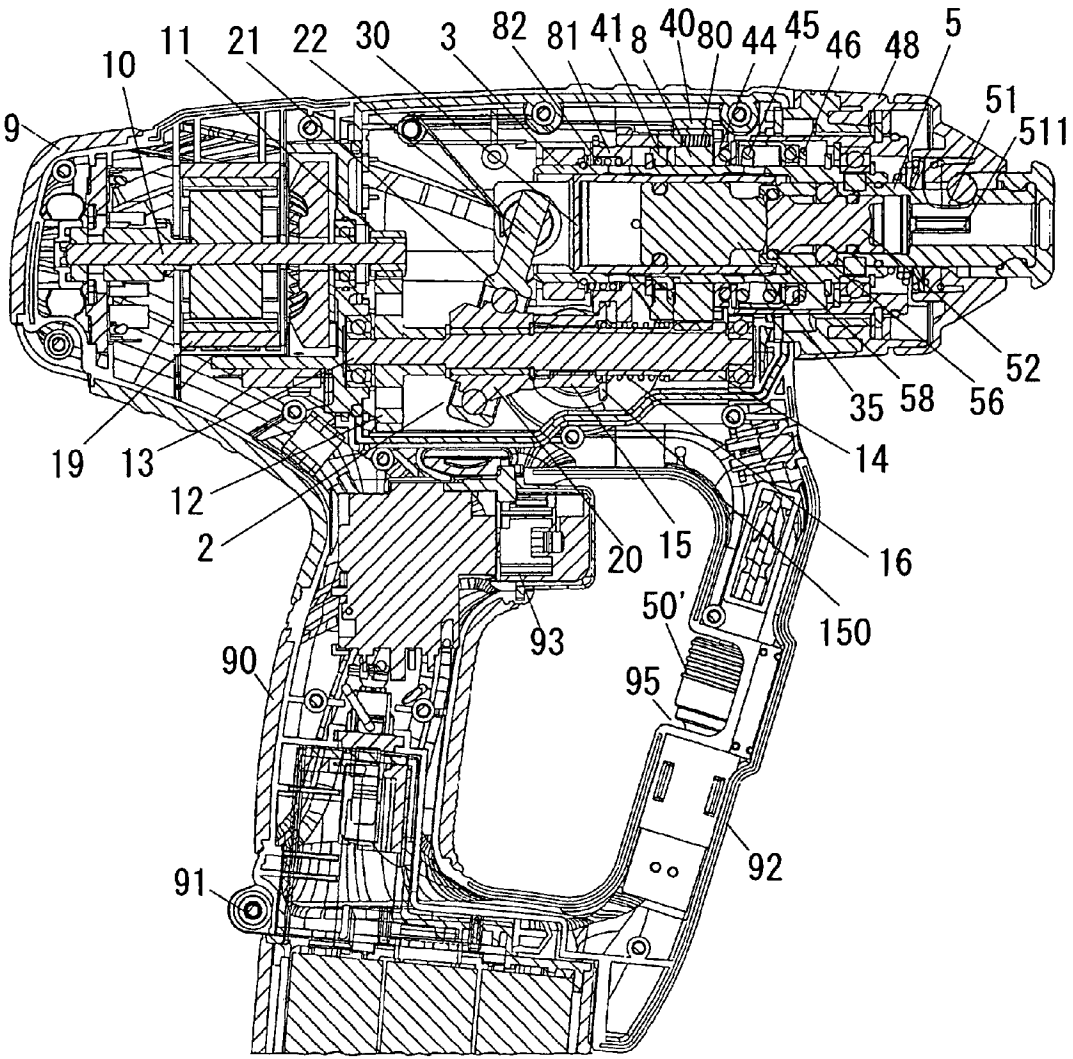
FIG. 22 is a vertical cross sectional view of the hammer drill shown in FIG. 20, which is set in a striking-motion-activated mode.

The pin 8 for directly coupling the rotating body 40 serving as a driving member to the clutch plate 41 functioning as a driven member (see FIG. 22). As the pin 8 is pressed by the spring 80 to protrude toward and engage with the clutch plate 41, the rotating body 40 and the clutch plate 41 are directly coupled to each other, thus ensuring that the rotational force of the rotating body 40 is always transferred to the clutch plate 41 and the cylinder 3.

Figure 20:
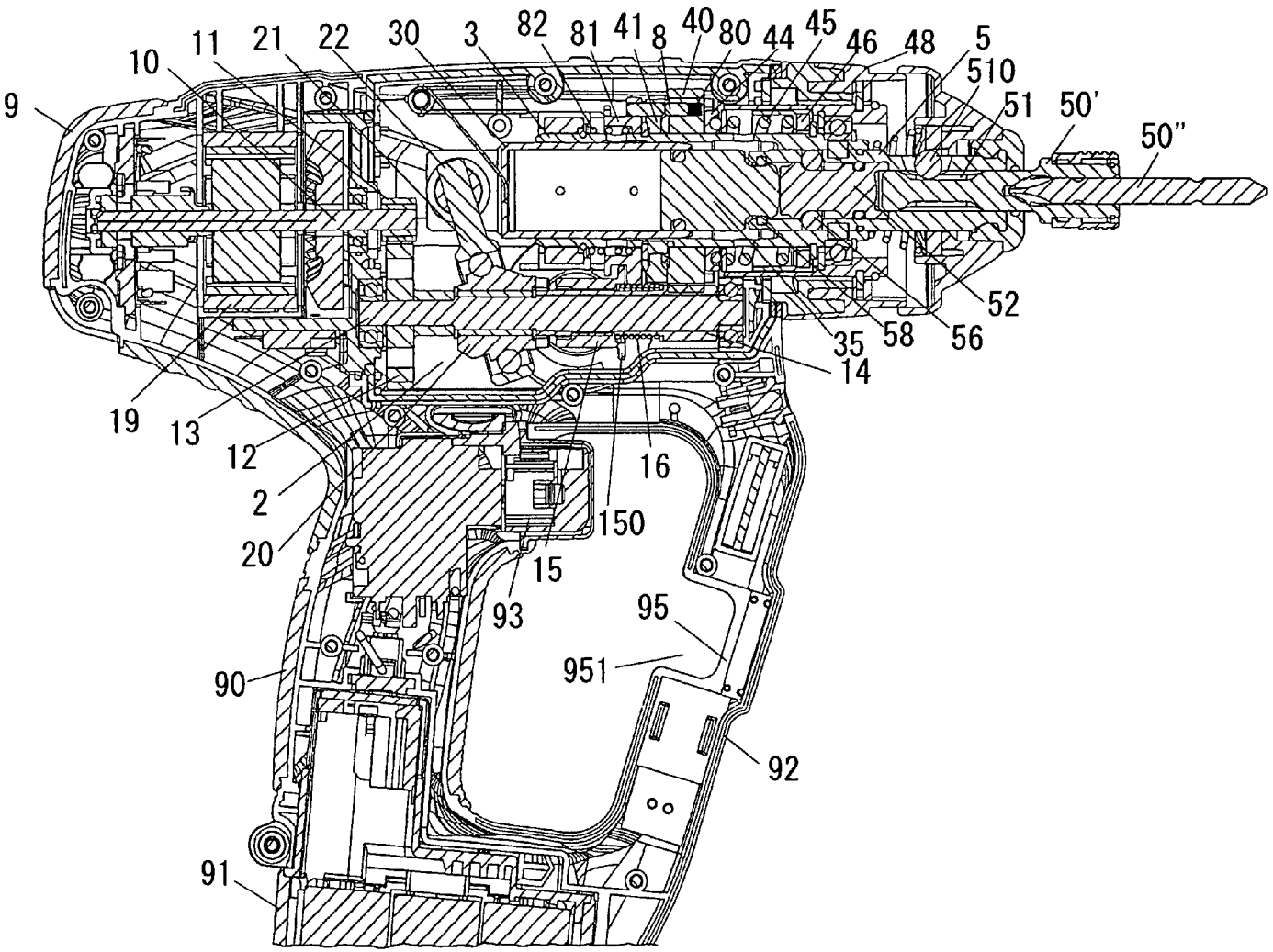
FIG. 20 is a vertical cross sectional view of a hammer drill in accordance with a fifth preferred embodiment of the present invention, which is set in a striking-motion-deactivated mode.

The conversion plate 81 is disposed around the outer circumference of the cylinder 3 in an axially movable manner. If the conversion plate 81 is pressed by the spring 82 to move forward, the distal end of the direct-coupling pin 8 is placed at a boundary surface of the rotating body 40 and the clutch plate 41 as illustrated in FIG. 20, thus releasing the direct coupling between the rotating body 40 and the clutch plate 41. At the time when the collar 15 is moved into engagement with the rotating portion 20, the conversion plate 81 is pressed by the collar 15 and moves backward against the spring 82, thus allowing the pin 8 to directly couple the rotating body 40 to the clutch plate 41.

The spindle 5 is attached to the axial front end of the cylinder 3 for unitary rotation with the cylinder 3. The spindle 5 is provided at its axial front end with the chuck portion 51 for holding the output bit 50". The chuck portion 51, which corresponds to an SDS-plus type shank, includes a removal-inhibiting ball 510 and a rotation-transferring internal protrusion 511 (see FIG. 21). The chuck portion 51 is designed to hold the output bit 50" in such a manner that the output bit 50" can be rotated with the chuck portion 51 as a unit while sliding axially within a predetermined range of movement.

The piston 30 is of a cylindrical shape having a closed rear end and an opened front end. The striker 35 is slidably received within the piston 30. As the piston 30 makes reciprocating movement, the striker 35 is also caused to reciprocate, at which time the air within the space of the piston 30 enclosed by the striker 35 plays a role of an air spring. By the reciprocating movement thus caused, the striker 35 applies a striking force to the output bit 50" in an axial direction through the intermediate member 52 axially slidably retained within the spindle 5. Reference numeral 56 in the drawings designates a ball for keeping the intermediate member 52 from backward removal out of the spindle 5.

Figure 21:
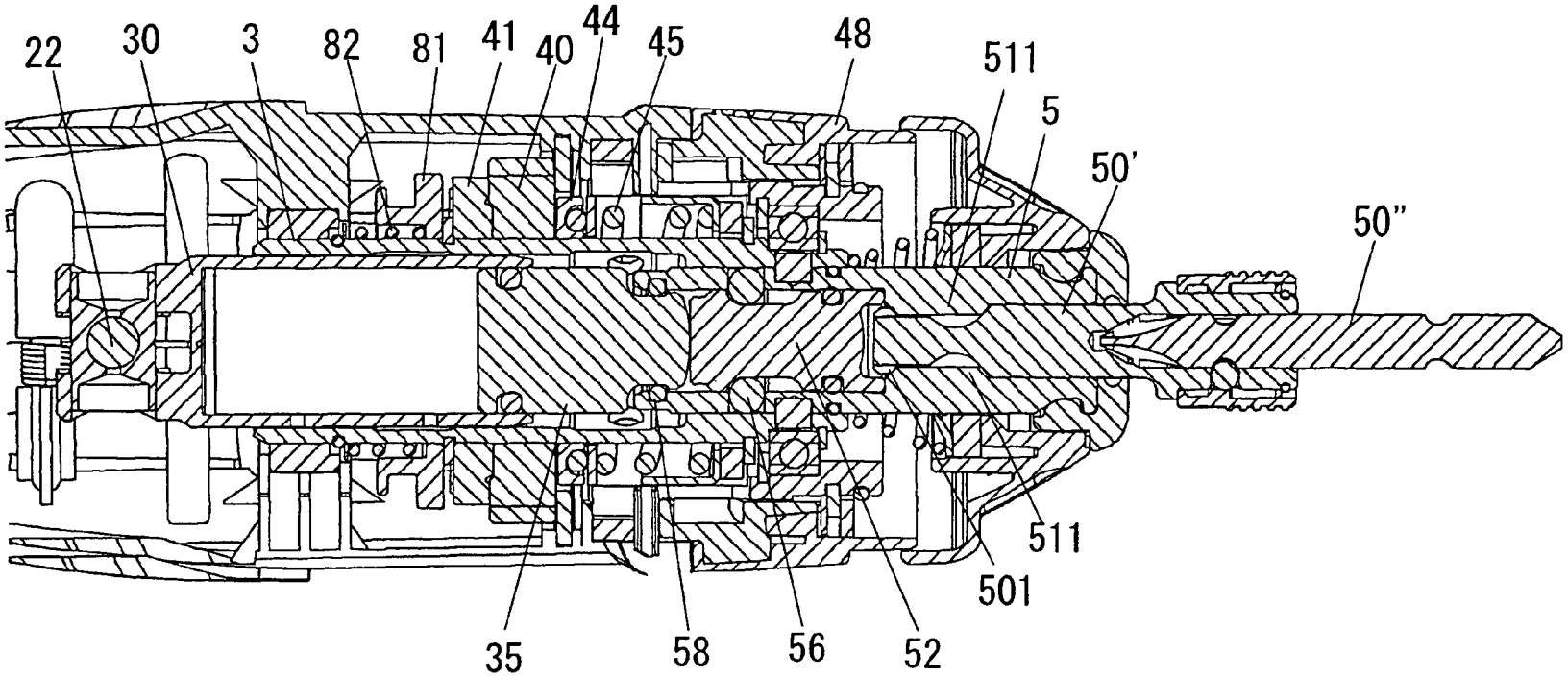
FIG. 21 is a horizontal cross sectional view of the hammer drill shown in FIG. 20, which is set in a striking-motion-deactivated mode.

FIGS. 20 and 21 illustrate a striking-motion-deactivated mode, i.e., a condition devoted to screw tightening. In order to attain this mode, the collar 15 is caused to move forward by the manipulation of the switching handle 7, thus releasing the engagement between the collar 15 and the rotating portion 20. Concurrently, the flange portion 150 of the collar 15 removes the pushing force applied to the conversion plate 81, in response to which the conversion plate 81 moves forward under the pressing force of the spring 85 to push the direct-coupling pin 8. This releases the direct coupling between the rotating body 40 and the clutch plate 41. Thus, the rotational force that the rotating body 40 receives from the pinion 14 of the connecting shaft 13 is transferred to the spindle 5 through the steel balls 42, the clutch plate 41 and the cylinder 3. At this moment, the O-ring 58 disposed on the rear inner circumference of the spindle 5 is resiliently engaged with the front outer circumference of the striker 35, thereby preventing the striker 35 and the intermediate member 52 from any axial movement. Accordingly, no inadvertent movement is caused to the striker 35 and the intermediate member 52.

In the process of tightening, e.g., a screw, through the use of the rotating output bit 50" in the striking-motion-deactivated mode, if the load torque becomes greater than the engaging force between the steel balls 42 and the clutch plate 41 imparted by the clutch spring 45, the steel balls 42 are escaped from the engaging recesses of the clutch plate 41, thus interrupting the transfer of the rotational force from the rotating body 40 to the clutch plate 41 (cylinder 3). This restrains the tightening torque.

The tightening torque can be increased by turning the clutch handle 48 as set forth above and displacing the movable plate 46 backward to increase the level of compression of the clutch spring 45. This means that the rotating body 40 and the clutch plate 41 cooperate with the steel balls 42, the movable plate 46 and the clutch spring 45 to form a torque-adjusting clutch 4. At the time when the clutch spring 45 has been compressed to the maximum extent by the manipulation of the clutch handle 48, the steel balls 42 is kept in a condition that it cannot be escaped from the engaging recesses. This condition is suitable for what is called a drilling work.

Figure 23:
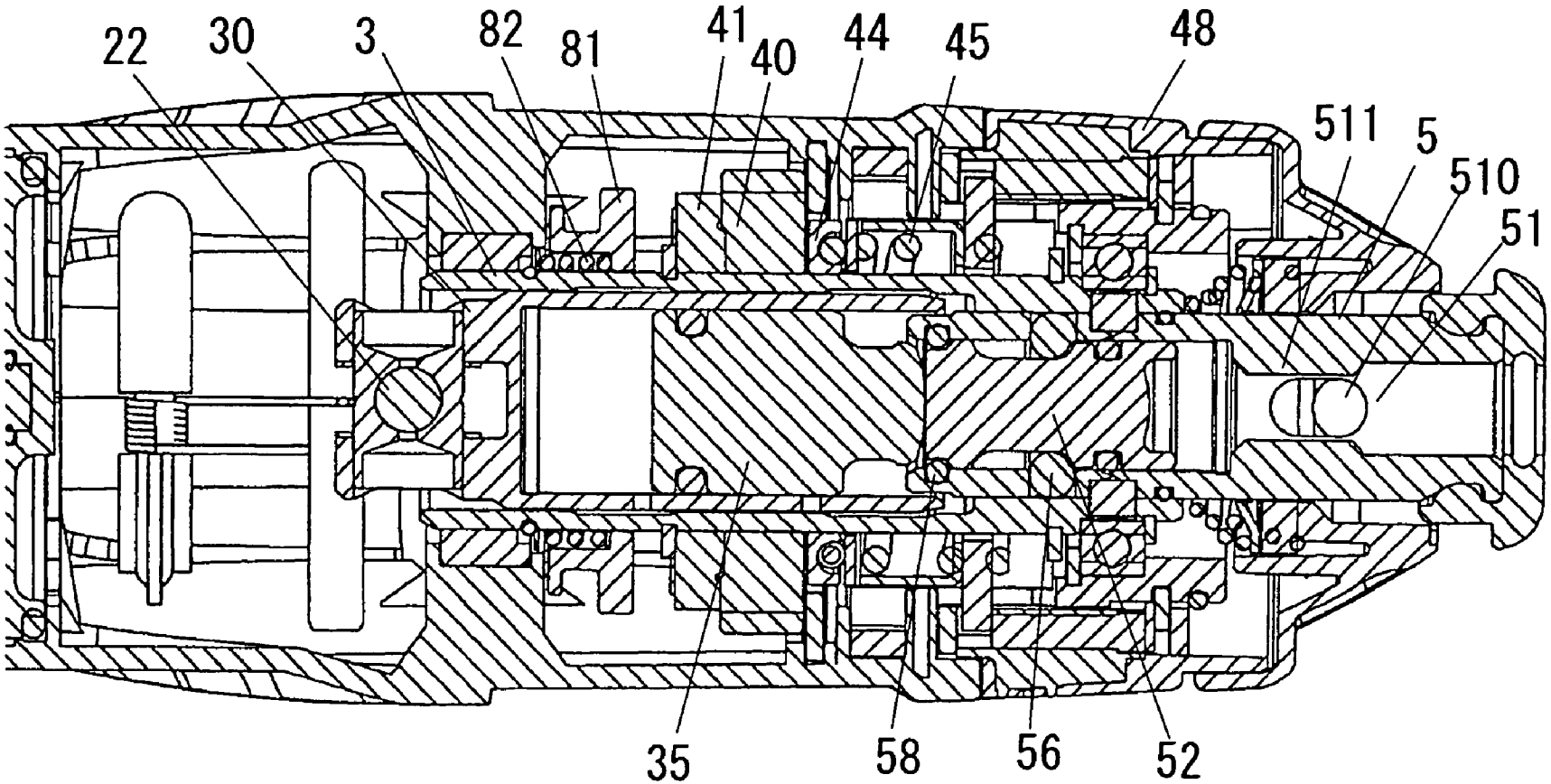
FIG. 23 is a horizontal cross sectional view of the hammer drill shown in FIG. 20, which is set in a striking-motion-activated mode.

Under the situation illustrated in FIGS. 22 and 23 wherein the collar 15 is moved backward into engagement with the rotating portion 20 by the manipulation of the switching handle 7, the collar 15 causes the conversion plate 81 to move backward against the spring 82, thus ensuring that the rotating body 40 and the clutch plate 41 are directly coupled by the direct-coupling pin 8. Accordingly, the piston 30 is reciprocated by the motion conversion member 2, while the cylinder 3 and the spindle 5 are rotatingly driven at all times. At this moment, as the output bit 50" is pressed against a drilling object, the output bit 50" and the intermediate member 52 are moved backward, to thereby push the striker 35 in a rearward direction beyond the position wherein the striker 35 is retained in place by the O-ring 58. Thus, the reciprocating movement of the piston 30 leads to the reciprocating movement of the striker 35, which means that the striker 35 is in condition for applying a striking force to the output bit 50" in an axial direction through the intermediate member 52. This makes sure that the rotational force and the axial striking force are transferred to the output bit 50".

The switching handle 7 is adapted to displace the collar 15 out of engagement with the rotating portion 20. The pressing force of the spring 16 is used in causing the collar 15 to move toward and smoothly engage with the rotating portion 20. The spring 16 is designed to have a pressing force greater than that of the spring 82 for pressing the conversion plate 81. Furthermore, the pressing force of the spring 82 is greater than that of the spring 80 for pressing the direct-coupling pin 8.

In the meantime, such an output bit 50" as a drill bit or a driver bit is provided with no SDS-plus type shank for use with the hammer drill and therefore is mounted with the use of an adapter 50' having the SDS-plus type shank. The SDS-plus type shank employed in the adapter 50' differs somewhat from a typical SDS-plus type shank shown in FIG. 27B.

Figure 27A:
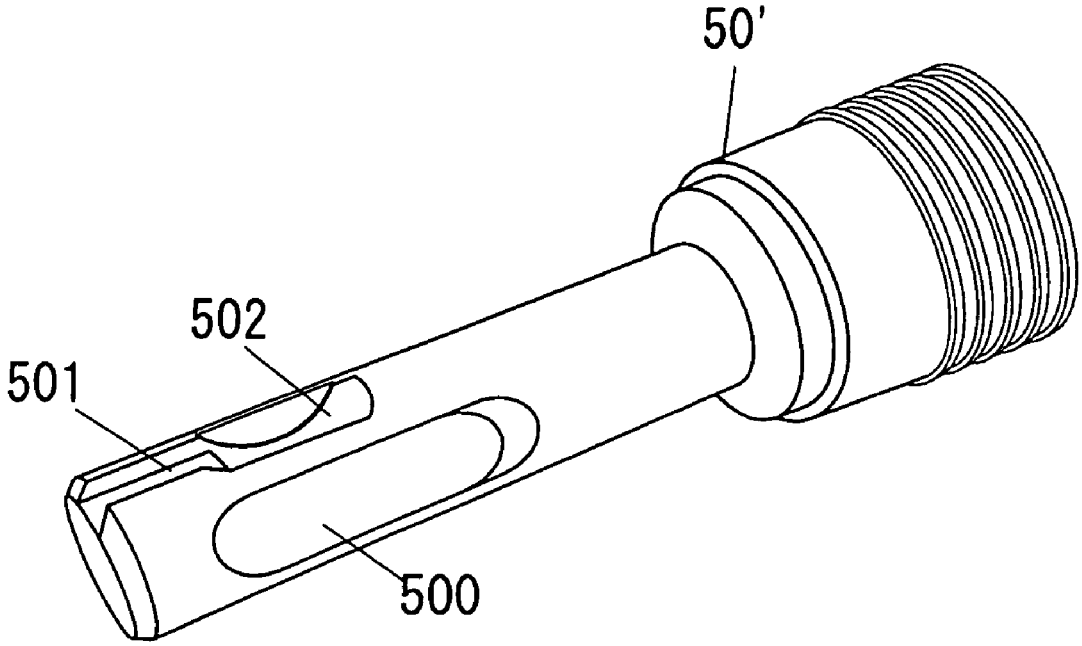
FIG. 27A is a perspective view of an adapter and FIG. 27B is a perspective view showing a typical SDS-plus type shank of an output bit.

More specifically, as illustrated in FIG. 27A, the SDS-plus type shank of the adapter 50' is the same as the typical SDS-plus type shank in that the adapter 50' has an insertion groove 500 for engagement with the removal-inhibiting ball 510 and a slide groove 501 with which the rotation-transferring internal protrusion 511 is slidingly engaged. A distinctive feature of the adapter 50' resides in that the axial length of the slide groove 501 measured from the rear end of the shank is short. In other words, at the time of mounting the adapter 50' into the chuck portion 51, the depth of insertion of the adapter 50' is restrained by the stopping action of the internal protrusion 511. This prevents the adapter 50' from moving backward into contact with the front end of the intermediate member 52 at its rear end.

Thus, even when the output bit 50" such as a drill bit or a driver bit is mounted through the adapter 50' in the striking-motion-activated mode, i.e., hammer drill mode, where the rotational force and the striking force are applied jointly, there is no possibility that the striking force is applied to the adapter 50'. This also precludes the possibility that the adapter 50', the output bit 50 such as a drill bit or a driver bit, and the screw or the like in contact with the distal end of the output bit 50" are damaged by the striking vibration. In addition, the striker 35 continues to be retained in position by means of the O-ring 58 for the reasons noted above.

Figure 27B:
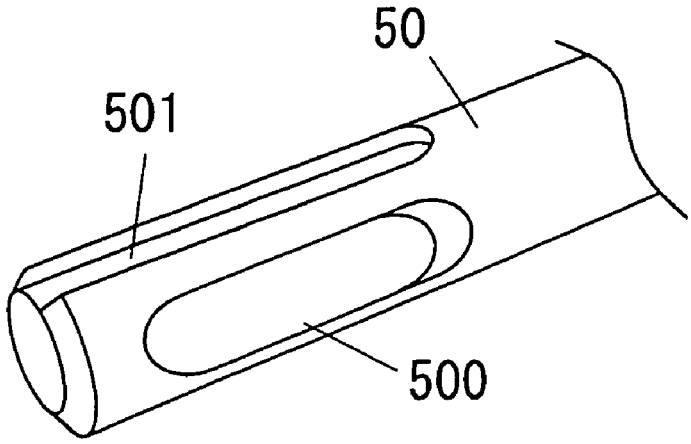

In the event that, as the output bit 50", a hammer drill bit having the typical SDS-plus type shank illustrated in FIG. 27B is mounted to the chuck portion 51, the output bit 50" can be moved backward to such an extent that the rear end of the output bit 50" makes contact with the intermediate member 52. Furthermore, the striker 35 can be displaced backward through the intermediate member 52 beyond the position where the striker 35 is retained in place by means of the O-ring 58, in which condition the striking force as well as the rotational force is applied to the output bit 50".

The slide groove 501 of the adapter 50' differs not only in length but also in inner end shape from that of the typical shank. The internal protrusion 511 has a front end comprised of a flat inclined surface. For this reason, if the front end of the internal protrusion 511 makes contact with the inner end of the slide groove 501 of the typical shank shown in FIG. 27A, the side edges of the inner end of the slide groove 501 are cut away. To avoid such a situation, the slide groove 501 of the adapter 50' is designed to have a slant inner end surface 502 capable of making surface-to-surface contact with the front end of the internal protrusion 511.

Figure 24:
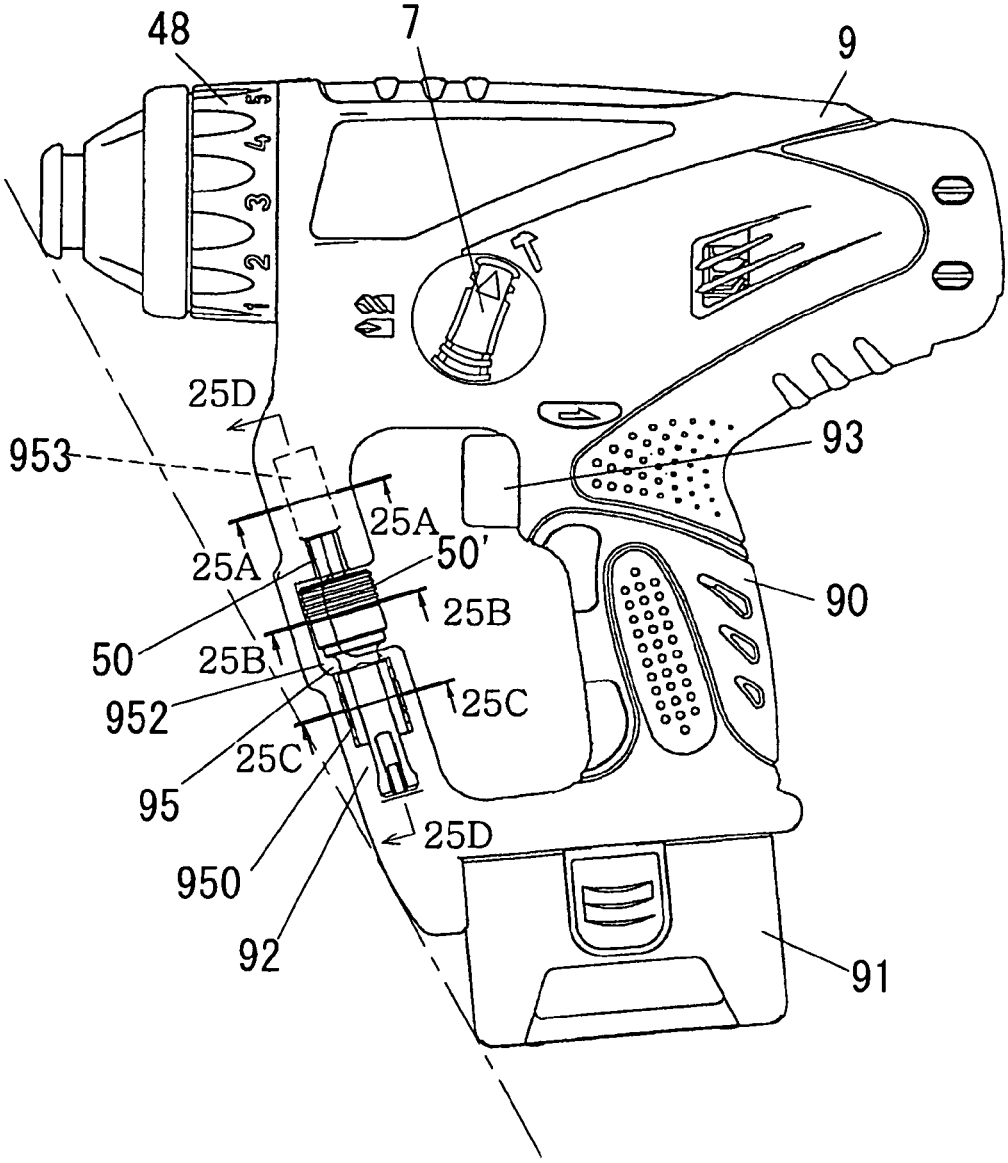
FIG. 24 is a side elevational view of the hammer drill shown in FIG. 20.

In this regard, the adapter 50' may be stored, when not in use, within a holder portion 95 provided in the connecting portion 92 of the housing 9. As depicted in FIGS. 24 and 25, the holder portion 95 is in the form of a recessed space opened to one side of the connecting portion 92. The holder portion 95 has a spring plate 950 for retaining the shank portion of the adapter 50', an enlarged recess part 952 for receiving the large diameter chuck portion of the adapter 50', and a void part 953 for accommodating the output bit 50" when the adapter 50' is stored with the output bit 50" attached thereto. At the other side of the enlarged recess part 952, the connecting portion 95 has a reduced thickness to provide an access space 951 through which the fingers of a user gain access to the large diameter chuck portion of the adapter 50' to take out the adapter 50'.

Figure 28:
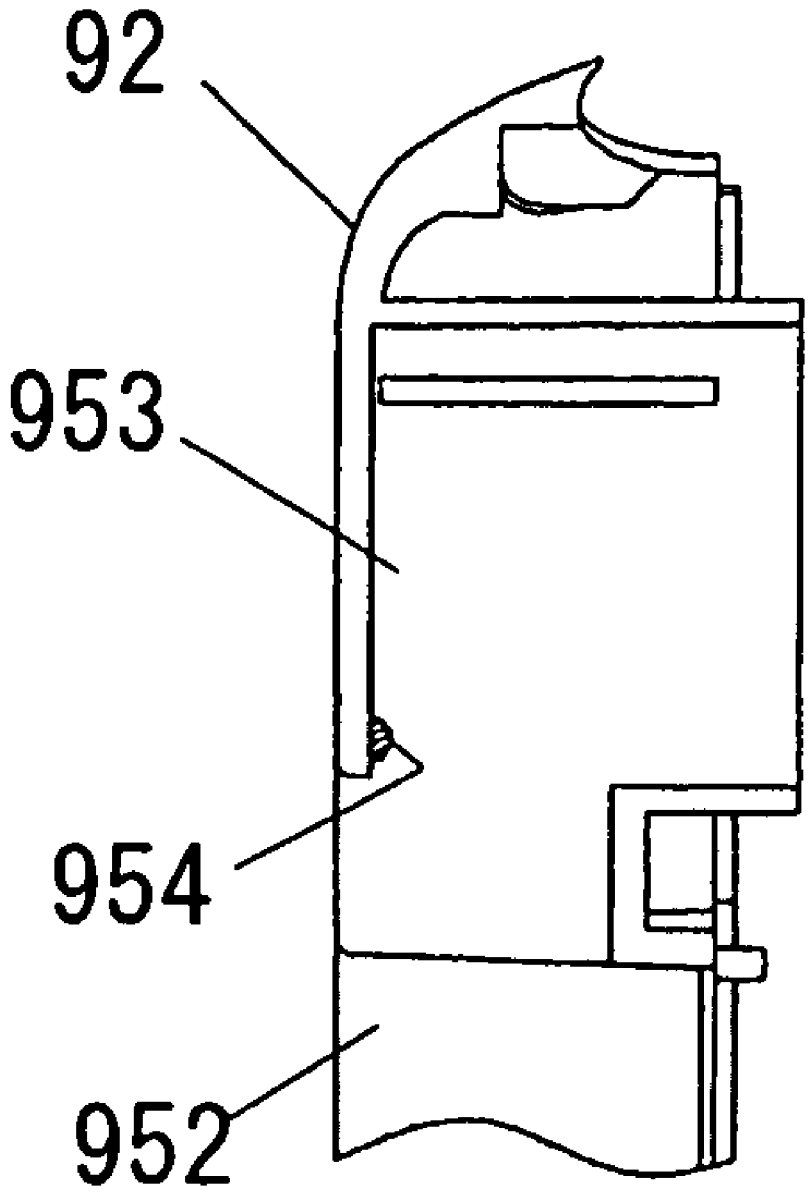
FIG. 28 is a partial cross sectional view showing a modified example of a holder portion.

In order to store the adapter 50' carrying the output bit 50" in the holder portion 95 with no removal of the output bit 50", the front end of the output bit 50" is inserted into the void part 953 as illustrated in FIG. 25D, after which the large diameter chuck portion of the adapter 50' is received within the enlarged recess part 952 and the shank portion of the adapter 50' is pushed into the seat portion of the spring plate 950. The above-noted storing operations are conducted in the reverse order to take out the adapter 50'. In the process of taking out the adapter 50', it is likely that, as can be seen in FIG. 25D, the output bit 50" may be contacted with the side wall edge 955 of the connecting portion 92 to thereby scratch or damage the edge 955. For this reason, it is desirable to provide a reinforcing rib 954 on the side wall of the connecting portion 92 as illustrated in FIG. 28.

In addition to the above, the connecting portion 92 is shaped not to protrude forward over a line joining the lower end of the battery pack 91 and the front end of the hammer drill (see FIG. 24). This is to prevent any damage of the connecting portion 92 which would otherwise be caused by the shock when the hammer drill is inadvertently fallen in the frontward direction.

The hammer drill in accordance with the present invention performs an operating mode where a rotational force alone is transferred to an output bit, while allowing a user to control a screw tightening torque with the use of a tightening-torque adjusting clutch. This makes it possible for a single hammer drill to carry out two kinds of works, namely, a task of drilling an object member, such as a concrete structure or the like, and a task of tightening a screw.

While the invention has been shown and described with respect to the preferred embodiments, it will be understood by those skilled in the art that various changes and modifications may be made without departing from the scope of the invention as defined in the following claims.

What is claimed is:

1. A hammer drill comprising:

a motor;

a spindle rotatingly driven by the motor and holding an output bit;

a motion conversion member for converting rotational movement of the motor to reciprocating movement;

a striker reciprocatingly driven by the motion conversion member for applying an axial striking force to the output bit;

a striking-motion-releasing mechanism for releasing the striking force applying action exercised by the striker;

a tightening-torque adjusting clutch for interrupting the transfer of the rotational force to the output bit by increasing a load torque; and a clutch handle for adjusting a fastening torque of the tightening-torque adjusting clutch, wherein when the striking force applying action is not released, the fastening torque is not allowed to be adjusted by the clutch handle, and when the striking force applying action is released, the fastening torque is allowed to be adjusted by the clutch handle, wherein the tightening-torque adjusting clutch is adapted to directly couple a driving side to a driven side at the time when the striking force applying action is not released, so that the fastening torque is not adjusted by the clutch handle, wherein the driving side is rotated by the motor, and the driven side is rotated by the driving side to rotate the spindle, wherein the hammer drill further comprises a pin commonly located inside both a hole of the driving side and a hole of the driven side when the driving side and the driven side are directly coupled, and wherein the tightening-torque adjusting clutch is adapted to directly couple a driving side to a driven side at the time when the striking force applying action is not released, so that the driving side does not slip over the driven side.

2. The hammer drill of claim 1, wherein the tightening-torque adjusting clutch is adapted to convert the direct coupling of the driving side and the driven side to non-direct coupling and vice versa in response to the actuation of the striking-motion-releasing mechanism, wherein the non-direct coupling allows the fastening torque to be adjusted by the clutch handle.

3. The hammer drill of claim 1 or 2, wherein the striking-motion-releasing mechanism is adapted to conduct the releasing operation by interrupting the transfer of the rotational force to the motion conversion member.

4. The hammer drill of claim 1, wherein the pin is located inside the hole of the driving side only when the striking force applying action is released.

5. The hammer drill of claim of claim 4, wherein the pin moves in response to the movement of the striking-motion-releasing mechanism.

6. The hammer drill of claim 1, wherein the tightening-torque adjusting clutch is adapted to convert the direct coupling of the driving side and the driven side to non-direct coupling and vice versa in response to the actuation of the striking-motion-releasing mechanism, and the non-direct coupling allows the driving side to slip over the driven side.

7. A hammer drill comprising:

a motor;

a spindle rotatingly driven by the motor and holding an output bit;

a motion conversion member for converting rotational movement of the motor to reciprocating movement;

a striker reciprocatingly driven by the motion conversion member for applying an axial striking force to the output bit;

a striking-motion-releasing mechanism for releasing the striking force applying action exercised by the striker;

a tightening-torque adjusting clutch for interrupting the transfer of the rotational force to the output bit by increasing a load torque; and a clutch handle for adjusting a fastening torque of the tightening-torque adjusting clutch, wherein when the striking force applying action is not released, the fastening torque is not allowed to be adjusted by the clutch handle, and when the striking force applying action is released, the fastening torque is allowed to be adjusted by the clutch handle, wherein the tightening-torque adjusting clutch is adapted to directly couple a driving side to a driven side at the time when the striking force applying action is not released, so that the fastening torque is not adjusted by the clutch handle, wherein the driving side is rotated by the motor, and the driven side is rotated by the driving side to rotate the spindle, wherein the hammer drill further comprises a pin commonly located inside both a hole of the driving side and a hole of the driven side when the driving side and the driven side are directly coupled, wherein the tightening-torque adjusting clutch is adapted to convert the direct coupling of the driving side and the driven side to non-direct coupling and vice versa in response to the actuation of the striking-motion-releasing mechanism, wherein the non-direct coupling allows the fastening torque to be adjusted by the clutch handle, and wherein the pin is located inside the hole of the driving side only when the driving side and the driven side are non-directly coupled.

8. The hammer drill of claim of claim 7, wherein the pin moves in response to the movement of the striking-motion-releasing mechanism.

* * * * *